US006390465B1

(12) United States Patent
Kakigi

(10) Patent No.: US 6,390,465 B1
(45) Date of Patent: May 21, 2002

(54) SHEET PROCESS APPARATUS PERFORMING BINDING PROCESS ON SHEETS FEATURING A CONTROLLER FOR SHIFTING SHEET DISCHARGE

(75) Inventor: Nobuyoshi Kakigi, Sakura (JP)

(73) Assignee: Canon Kabushiki Kaisha, Tokyo (JP)

( * ) Notice: Subject to any disclaimer, the term of this patent is extended or adjusted under 35 U.S.C. 154(b) by 0 days.

(21) Appl. No.: 09/160,383

(22) Filed: Sep. 25, 1998

(30) Foreign Application Priority Data

Sep. 30, 1997 (JP) ..... 9-266422

(51) Int. Cl.[7] ..... B65H 31/00; B65H 39/00; B42C 1/12

(52) U.S. Cl. ..... 271/207; 271/213; 271/220; 271/200; 271/314; 414/791.2; 270/58.08; 700/219

(58) Field of Search ..... 271/207, 213, 271/184, 185, 186, 187, 176, 220, 200, 314; 414/791.2; 270/58.08; 700/219

(56) References Cited

U.S. PATENT DOCUMENTS 5,007,625 A * 4/1991 Kremers et al. ..... 270/58.01
5,088,721 A * 2/1992 Suzuki et al. ..... 271/293
5,145,167 A * 9/1992 McGraw et al. ..... 271/186
5,513,839 A * 5/1996 Green ..... 270/58.07
5,618,035 A * 4/1997 Coombs et al. ..... 271/213
6,047,960 A * 4/2000 Kawano et al. ..... 271/184

* cited by examiner

*Primary Examiner*—Donald P. Walsh
*Assistant Examiner*—Johnathan R Miller
(74) *Attorney, Agent, or Firm*—Fitzpatrick, Cella, Harper & Scinto

(57) ABSTRACT

A sheet process apparatus includes a stapler for performing a stapling process on a sheet any a shift sheet discharge unit for performing shift sheet discharging. The shift sheet discharging discharges and stacks the sheets on a tray in a status that the sheet intended to be discharged is shifted from the sheet already put on the tray. A control unit causes the shift sheet discharge unit to perform shift sheet discharging when the stapling process by the stapler is not included in any of a previous-time job and a present-time job. The control unit also causes the shift sheet discharge unit to perform the shift sheet discharging when the stapling process by the stapler is not included in any of a previous-time job and a present-time job. In addition, the control unit also causes the shift sheet discharge unit to discharge the sheet without performing the shift sheet discharging when the stapling process by the stapler is included in at least one of the previous-time job and the present-time job.

99 Claims, 14 Drawing Sheets

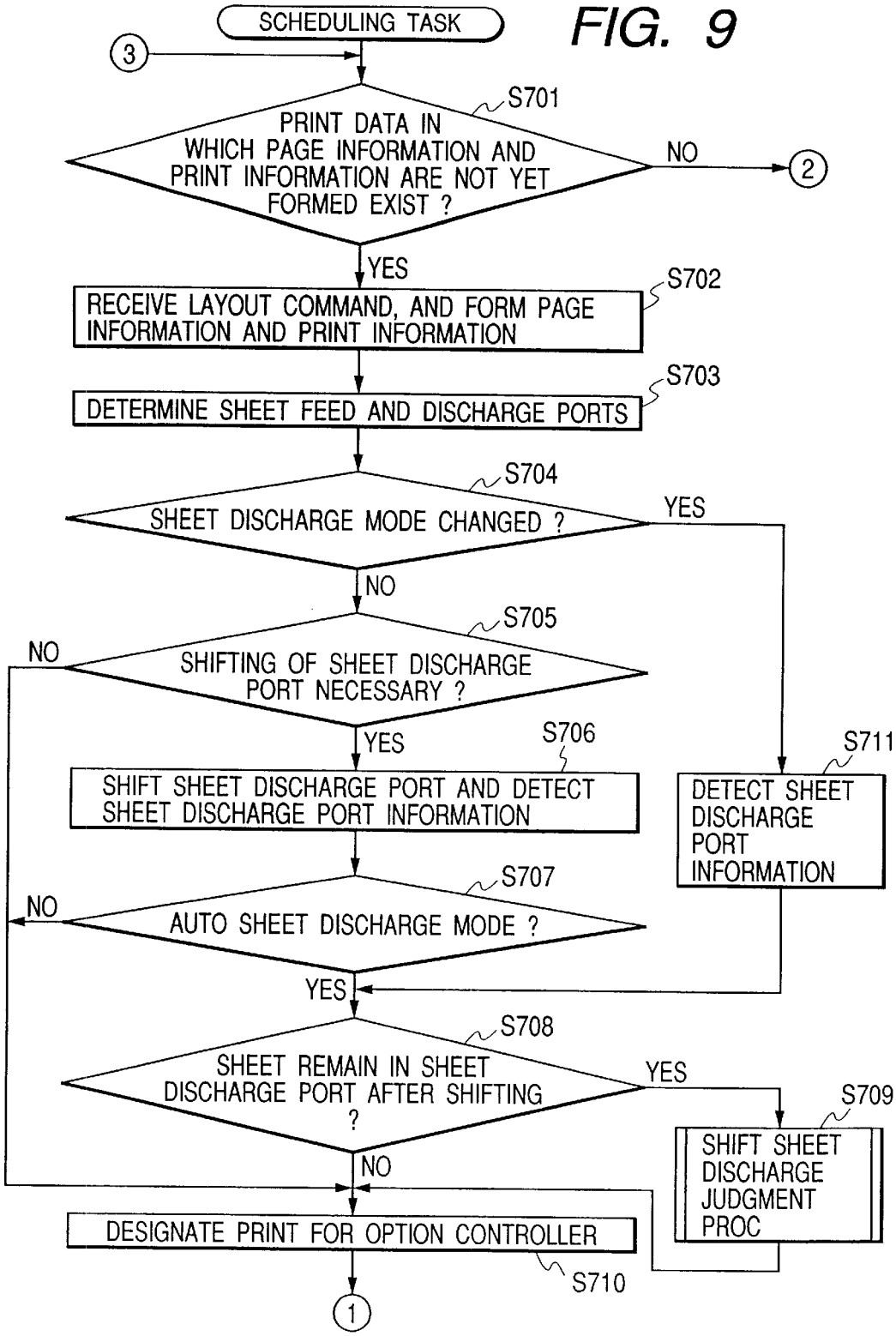
FIG. 9
SCHEDULING TASK
3
S701
PRINT DATA IN WHICH PAGE INFORMATION AND PRINT INFORMATION ARE NOT YET FORMED EXIST ?
NO
2
YES
S702
RECEIVE LAYOUT COMMAND, AND FORM PAGE INFORMATION AND PRINT INFORMATION
S703
DETERMINE SHEET FEED AND DISCHARGE PORTS
S704
SHEET DISCHARGE MODE CHANGED ?
YES
NO
S705
SHIFTING OF SHEET DISCHARGE PORT NECESSARY ?
NO
YES
S706
SHIFT SHEET DISCHARGE PORT AND DETECT SHEET DISCHARGE PORT INFORMATION
S711
DETECT SHEET DISCHARGE PORT INFORMATION
S707
AUTO SHEET DISCHARGE MODE ?
NO
YES
S708
SHEET REMAIN IN SHEET DISCHARGE PORT AFTER SHIFTING ?
YES
S709
SHIFT SHEET DISCHARGE JUDGMENT PROC
NO
DESIGNATE PRINT FOR OPTION CONTROLLER
S710
1

SHEET PROCESS APPARATUS PERFORMING BINDING PROCESS ON SHEETS FEATURING A CONTROLLER FOR SHIFTING SHEET DISCHARGE

BACKGROUND OF THE INVENTION

1. Field of the Invention

The present invention relates to a sheet process apparatus which performs a binding process on sheets.

2. Related Background Art

It has been proposed that a print apparatus having a plurality of sheet discharge ports (or trays) and capable of detecting a sheet loading (or stack) amount is connected to a plurality of host computers under a network environment. In case of receiving print instructions from a plurality of users, the print apparatus can discharge printed sheets to a arbitrary sheet port by appropriately designating a fixed mode in which the specific sheet discharge port is designated by each user, and an automatic mode in which the sheet discharge ports capable of discharging the sheets are automatically searched to determine the port to be used.

In such a print apparatus, in order that a plurality of kinds of job sheets are not mixed with others in one sheet discharge port, the sheet loading amount in the sheet discharge port to be actually used to discharge the sheets is detected. Then, if a sheet already exists in the port, a message is displayed before printing starts to urge the user to remove the sheet from the port. However, it has been troublesome for the user because he is certainly urged to remove the sheet when the sheet already exists in the port to which the sheet is intended to be discharged.

SUMMARY OF THE INVENTION

An object of the present invention is to provide a sheet process apparatus which solves the above-described problem.

An another object of the present invention is to provide a sheet process apparatus which can make it unnecessary to urge a user to remove a sheet from a sheet discharge port or can reduce the number of times the user is urged to remove the sheet.

A still another object of the present invention is to provide a sheet process apparatus in which, even when a job including a sheet binding process and a job not including the sheet binding process are appropriately performed, it does not become difficult to easily find a pause or boundary of each job.

Other objects and features of the present invention will become apparent from the following detailed description and the accompanying drawings.

BRIEF DESCRIPTION OF THE DRAWINGS

FIG. 9 is a flowchart showing an example of scheduling procedure by the control unit 109 shown in FIG. 1;

DETAILED DESCRIPTION OF THE PREFERRED EMBODIMENTS

Hereinafter, embodiments of the present invention will be explained in detail with reference to the accompanying drawings.

(First Embodiment)

Figure 1:
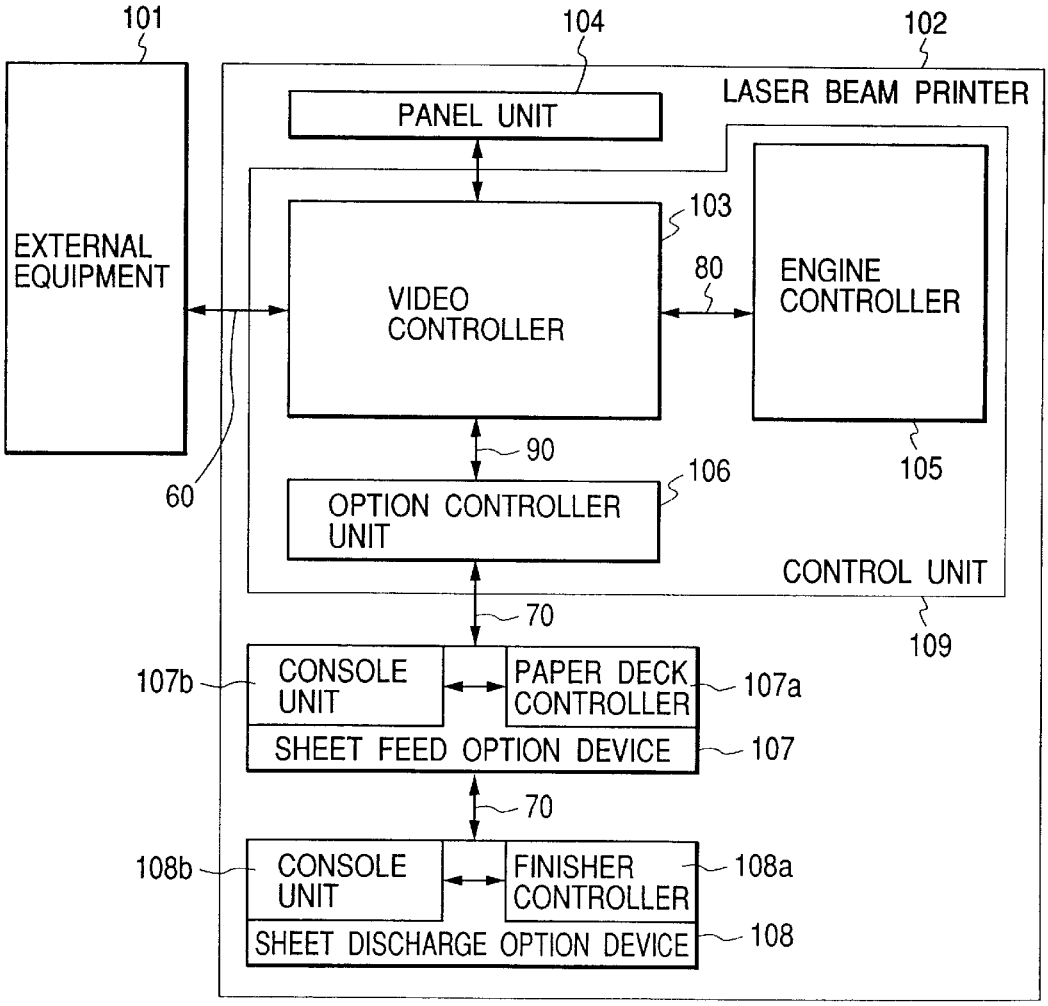
FIG. 1 is a block diagram showing an embodiment of the present invention.

FIG. 1 shows the first embodiment of the present invention. Although the drawing discloses an example of a laser beam printer 102, a printer or other print system such as an inkjet printer or the like can be also applied. Further, although the present embodiment discloses an example that the laser beam printer 102 connects with two sheet feed option devices is disclosed, the printer 102 can connect with three or more sheet feed option devices. Moreover, the laser beam printer itself may include functions of the sheet feed option devices.

The laser beam printer 102 is connected to an external equipment 101 such as a host computer or the like through a general-purposes interface 60 (e.g., Centronics, RS232C or the like). The printer 102 is capable of connecting with various option devices performs image recording on the basis of print information (i.e., control information such as code data or the like based on predetermined printer language; including, e.g., PostScript, LIPS(III), LIPS(IV), image data and the like) transferred from the external equipment 101 through the interface 60. The printer 102 is composed of a panel unit 104, a control unit 109, a sheet feed option device 107 and a sheet discharge option device 108.

The panel unit 104 which is composed of various switches (buttons) for various operations, an LED (light emission diode) display, an LCD (liquid crystal display) and the like is an interface to a user. That is, the user can instruct the printer 102 to perform a predetermined operation by handling the panel unit 104. Various data and the like set by the user are stored and managed in a not-shown nonvolatile memory such as an NVRAM (nonvolatile random access memory), an EEPROM (electrically erasable and programmable read-only memory) or the like.

The control unit 109 is composed of an engine controller 105, a video controller 103 and an option controller unit 106.

The engine controller 105 performs print process controlling for the laser beam printer 102. The controller 105 forms a latent image on a photosensitive drum through a well-known electrophotographic process on the basis of the image data transferred from the video controller 103, and then performs printing by transferring and fixing the formed latent image onto a fed sheet. At this time, the controller 105 instructs the option controller unit 106 about sheet feed/discharge timing.

The video controller 103 controls the printer 102 as a whole, and also analyzes data sent from the external equipment 101 to convert it into the image data. The controller 103 is connected to the external equipment 101 through the general-purpose interface 60. Further, the controller 103 receives code data (ESC code, various PDL data and the like) transferred from the external equipment 101, generates page information consisting of dot data and the like on the basis of the received code data, transmits the image data (binary or multivalue data) to the engine controller 105 through a video interface 80, and then transmits a sheet feed designation command, a sheet discharge designation command and the like to the option controller unit 106 through an integrated interface 90.

The option controller unit 106 integrally controls the sheet feed and discharge option devices (or units). That is, the option controller unit 106 manages the respective option devices through a common option unit interface 70, and communicates with the video controller 103 through the integrated interface 90. The present embodiment is characterized by the operation that the respective sheet feed and discharge option devices are controlled by the video controller 103 through the option controller unit 106. The unit 106 composed of a CPU (central processing unit), a ROM, a RAM and the like all not shown is an integrated controller which integrally controls one or more option devices on the basis of the sheet feed and discharge designations transferred from the video controller 103, the sheet feed and discharge instructions sent from the engine controller 105, and the like. That is, the option controller unit 106 communicates with controllers respectively provided in the various option devices through the option unit interface 70, and thus integrally controls these option devices. A common memory (FIG. 5) which can be accessed by the video controller 103 is provided in the RAM of the option controller unit 106. This common memory is composed of a feed status management area capable of managing data of about 40 sheets, a basic status area, a command status management area, a starting-up process area and the like, and the video controller 103 performs various designations to the option devices through the necessary area in the common memory.

When a faceup mode is designated by the video controller 103 through the integrated interface 90, as later described in FIG. 4, a recording sheet S guided by a flapper 254 is fed to a sheet discharge port by rollers 255 as it is. On the other hand, when a facedown mode is designated by the video controller 103 through the interface 90, as later described in FIG. 4, the recording sheet S guided by the flapper 254 is fed by rollers 256 and 257 until a trailing edge of the sheet S once passes the rollers 256. Then, the rollers 257 are reversely rotated such that the sheet S is again fed from its trailing edge to the sheet discharge port through rollers 258.

The feed status management area is composed of an area used when the video controller 103 notifies each option device of a print method (sheet feed port, sheet discharge port, color, stapling operation, shift operation, etc.), and an area used when each option device notifies the video controller 103 of each option status (the number of printed sheets, completion of sheet discharge, etc.). The basic status area is an area used when each option device notifies the video controller 103 of its abnormality (sheet (or paper) jamming, no sheet, no stylus in stapler, etc.). The command status management area is an area used when each option device sends and receives a command status to and from the video controller 103. The starting-up process area is an area used when the video controller 103 designates a starting-up process of each option device.

The sheet feed option device 107 is, e.g., a paper (sheet) deck option unit, has therein a paper (sheet) deck controller (i.e., large-capacity sheet feed cassette controller) 107*a*, and performs sheet feed control on the basis of the control information transmitted from the option controller unit 106. The paper deck controller 107*a* has a CPU, a ROM and a RAM all not shown, and the CPU controls the sheet feed option device 107 on the basis of a program stored in the ROM. The ROM has previously stored expansion information of the device 107, e.g., information concerning a sheet size capable of being loaded or held in a paper (sheet) deck, and the like.

The sheet discharge option device 108 is, e.g., a finisher option unit having a stapling function, has therein a finisher controller (i.e., large-capacity sheet discharge stacker controller) 108*a*, and performs a stapling operation and a sheet discharge operation on the basis of the control information transmitted from the option controller unit 106. The finisher controller 108*a* has a CPU, a ROM and a RAM all not shown, and the CPU controls the sheet discharge option device 108 according to a program stored in the ROM. Such the ROM has previously stored expansion information of the device 108, e.g., information concerning the number of discharge ports, information concerning presence/absence of the stapling function, information concerning presence/absence of a shift function to shift the discharged sheet in a predetermined direction, information concerning presence/absence of an inversion function to invert a face direction of the discharged sheet, and the like.

Console units 107*b* and 108*b* each having a display unit and various keys are provided respectively in the sheet feed option device 107 and the sheet discharge option device 108. Thus, a message, a operation method and the like for the user can be displayed on the display unit when he actually uses each option to allow him to operate the option.

The option controller unit 106, the paper deck controller 107*a* and the finisher controller 108*a* are connected to others by connectors, and serial communication is performed among them by using the option unit interface 70. Since the sheet feed and discharge option devices 107 and 108 are connected in series by the same connector, the devices 107 and 108 can be connected in altered connecting order. The finisher controller 108*a* controls the finisher option unit, i.e., the sheet discharge option device 108.

Figure 2:
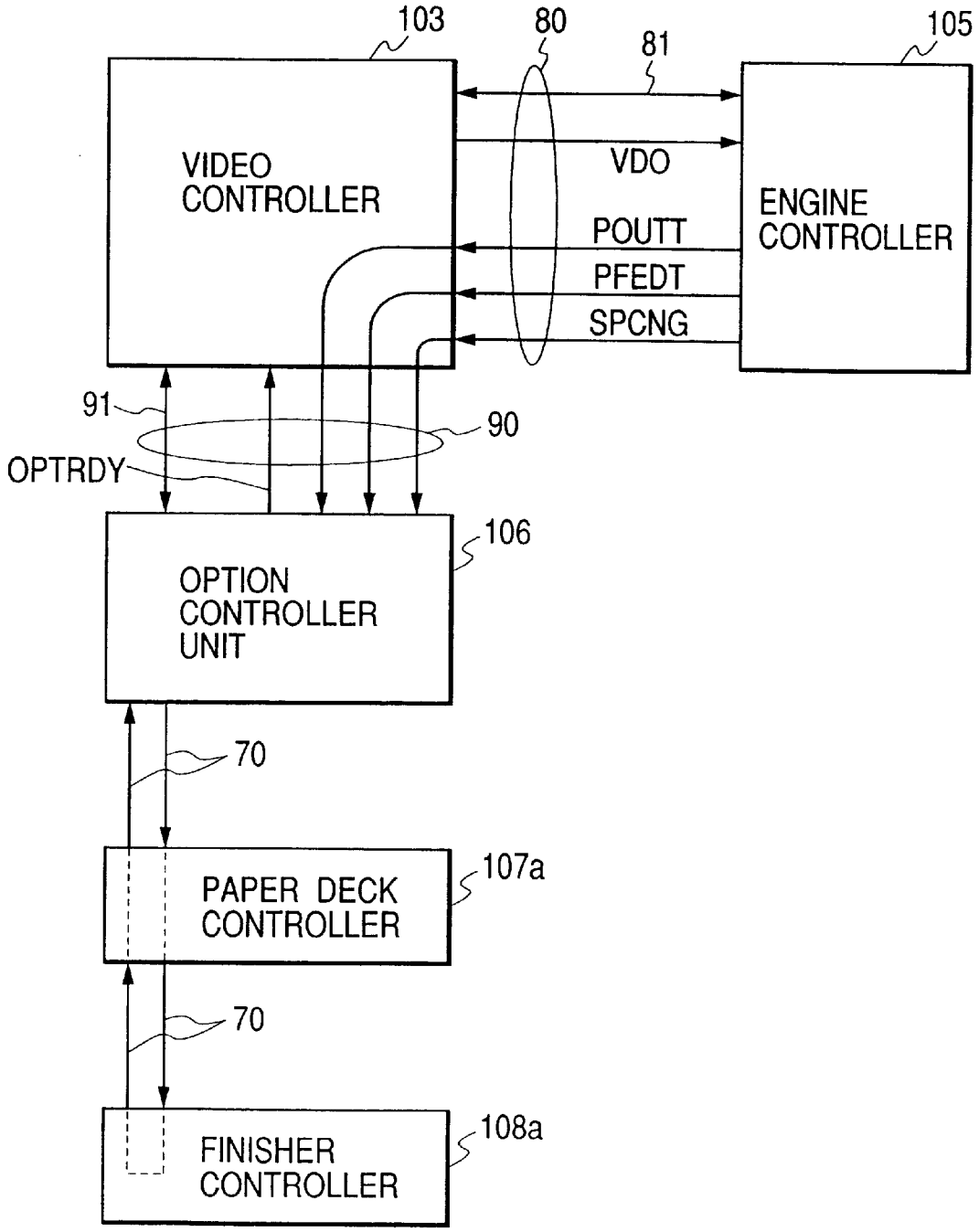
FIG. 2 is a view for explaining interfaces and signals of controllers in a laser beam printer 102 shown in FIG. 1.

Subsequently, the interfaces and signals of the respective controllers in the laser beam printer 102 will be explained in detail with reference to FIG. 2. The integrated interface 90 is composed of five hardware signals (signal lines), i.e., a serial communication interface 91, a signal OPTRDY, a signal POUTT, a signal PFEDT and a signal SPCNG. The serial communication interface 91 is used when various commands such as sheet feed designation to a paper deck 241 of the sheet feed option device 107, sheet discharge designation to sheet discharge ports (trays) 251 to 253 of the sheet discharge option device 108, and the like are transferred from the video controller 103 to the option controller unit 106, and is also used when various statuses such as a sheet presence/absence status of the paper deck 241 of the device 107, sheet loading statuses of the sheet discharge ports 251 to 253 of the sheet discharge option device 108, a stylus presence/absence status of the stapler, and the like are transferred from the option controller unit 106 to the video controller 103. It should be noted that the option controller unit 106 and the video controller 103 may be directly connected by a CPU bus. The signal OPTRDY is a signal representing whether or not the option, e.g., stapling designated by the video controller 103 is in a usable status, and is transferred from the option controller unit 106 to the video controller 103. The signal POUTT is a timing signal used when the printer 102 itself discharges the recording sheet, and is transferred from the engine controller 105 to the option controller unit 106 through the video controller 103. The signal PFEDT is a timing signal used when the printer 102 itself receives the recording sheet from the option unit, and is transferred from the engine controller 105 to the option controller unit 106 through the video controller 103. The signal SPCNG is a signal used when feeding speed of the recording sheet S fed in the option device at high speed is decreased to be matched to sheet feeding speed of the printer 102 itself, and is transferred from the engine controller 105 to the option controller unit 106 through the video controller 103.

The video interface 80 is composed of five hardware signals (signal lines), i.e., a communication interface 81, a signal VDO, the signal POUTT, the signal PFEDT and the signal SPCNG. The communication interface 81 is used when various commands such as sheet feed designation to the sheet feed cassette of the printer 102 itself, sheet discharge designation to the sheet discharge ports 251 to 253 of the printer 102 itself, a print command and the like are transferred from the video controller 103 to the engine controller 105, and is also used when various statuses such as a sheet presence/absence status of the cassette 230 of the printer 102 itself, sheet jamming and the like are transferred from the engine controller 105 to the video controller 103. The signal VDO is bit data transferred from the video controller 103 to the engine controller 105.

Figure 3:
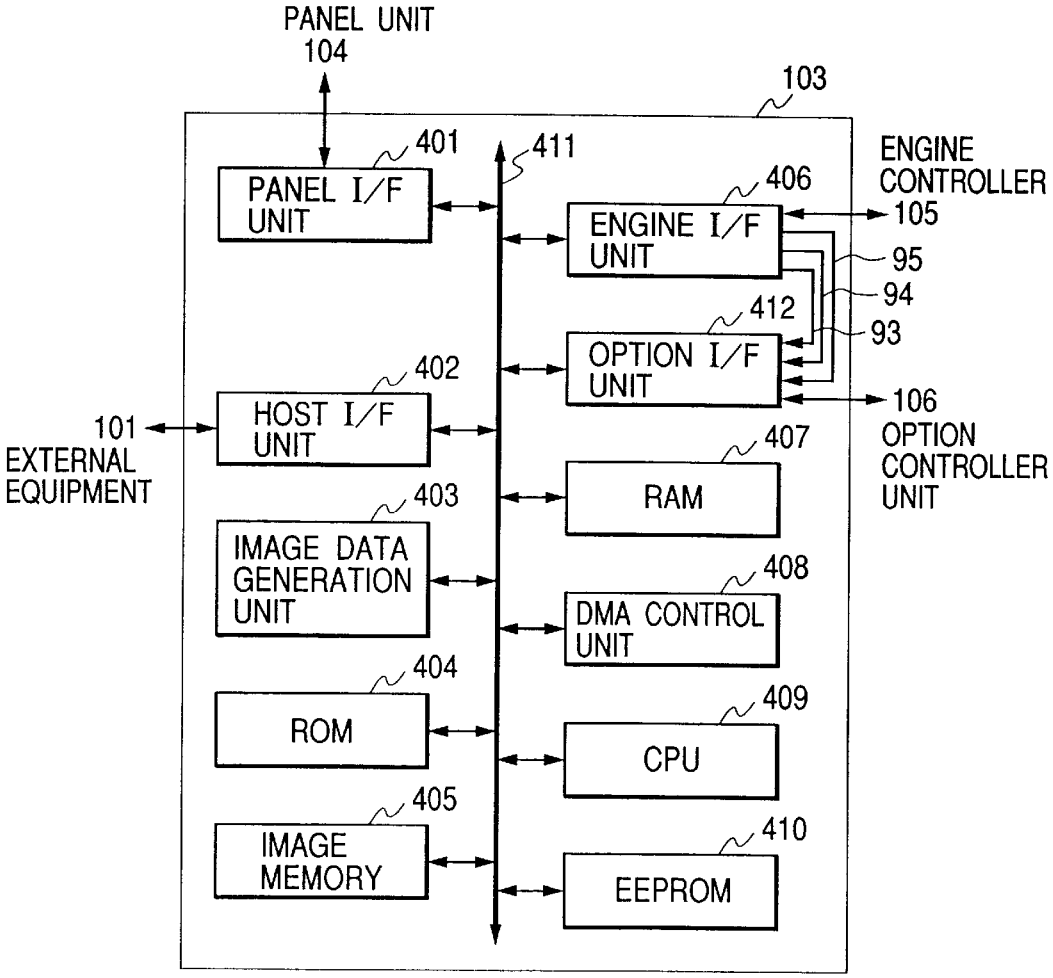
FIG. 3 is a block diagram showing a structure of a video controller shown in FIG. 1.

FIG. 3 shows a structure of the video controller 103 in FIG. 1. In FIG. 3, numerals 101, 104, 105 and 106 respectively denote the same elements as those shown in FIG. 1. Numeral 401 denotes a panel interface (I/F) unit used to receive various setting and instructions by an operator from the panel unit 104 through data communication with the unit 104. Numeral 402 denotes a host interface unit acting as a signal input/output unit between the video controller 103 and the external equipment 101 such as the host computer or the like. Numeral 406 denotes an engine interface unit acting as a signal input/output unit between the controller 103 and the engine controller 105. That is, the engine interface unit 406 is used to transmit a data signal from a not-shown output buffer register and also to control communication with the engine controller 105.

Numeral 403 denotes an image data generation unit for generating bit map data to be used in actual printing, on the basis of control code data sent from the external equipment 101. Numeral 405 denotes an image memory for storing the image data. Numeral 409 denotes a CPU for controlling the video controller 103 as a whole. It should be noted that a control code for controlling the CPU 409 is composed of an OS (operating system) performing time-divisional control in the unit of load module called as task on the basis of not-shown system clock, and a later-described plurality of load modules (tasks) operating in the unit of function. Numeral 404 denotes a ROM for storing the control codes of the CPU 409. Numeral 407 denotes a RAM used as a working area of the CPU 409. Numeral 410 denotes an EEPROM composed of a nonvolatile memory medium.

Numeral 408 denotes a DMA (direct memory access) control unit for transferring the bit map data in the image memory to the engine interface unit 406 according to the instruction from the CPU 409. Numeral 412 denotes an option interface unit for communicating with the option controller unit 106 according to the instruction from the CPU 409. The signals POUTT, PFEDT and SPCNG are transferred from the engine interface unit 406 to the integrated interface 90 through the option interface unit 412.

Numeral 411 denotes a system bus having an address bus and a data bus. The panel interface unit 401, the host interface unit 406, the image data generation unit 403, the ROM 404, the image memory 405, the engine interface unit 406, the RAM 407, the DMA control unit 408, the CPU 409, the EEPROM 410 and the option interface unit 412 are mutually connected to others through the system bus 411.

Figure 4:
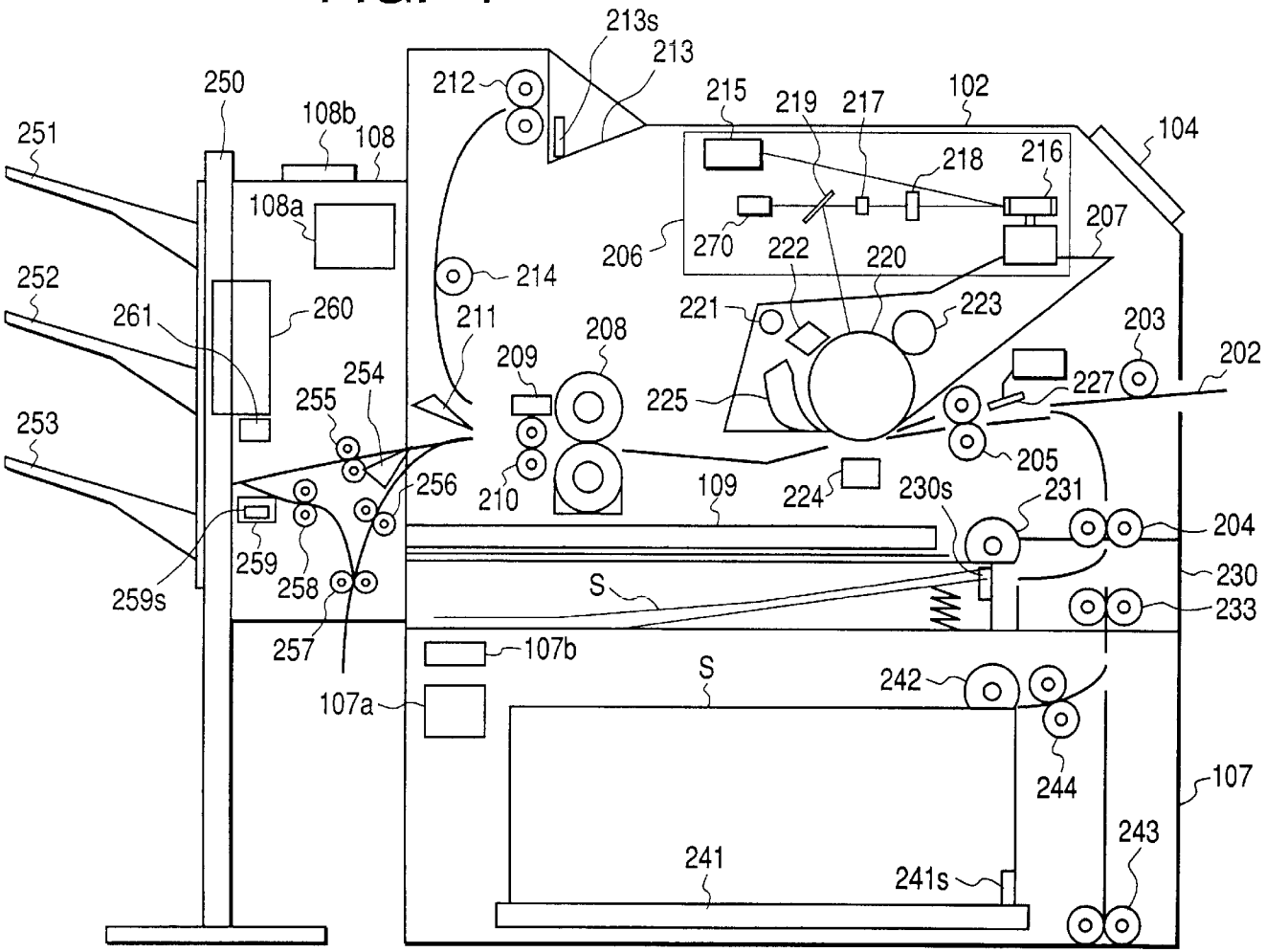
FIG. 4 is a sectional view showing a structure of the laser beam printer 102 shown in FIG. 1.

FIG. 4 shows a structure of the laser beam printer 102 in FIG. 1. In FIG. 4, the same elements as those shown in FIG. 1 are added with the same reference materials. In addition, numeral 230 denotes a sheet cassette for holding the recording sheet S and having a mechanism to electrically detect a size of the sheet S by using a not-shown partition board. Numeral 231 denotes a cassette sheet feed clutch intermittently rotated to pick up the recording sheet S one by one held in the cassette 230 and feed it up to sheet feed rollers 204. Numeral 230*s* denotes a recording sheet sensor for detecting an amount of the recording sheets S held in the cassette 230.

Numeral 227 denotes a resist shutter for depressing the sheets to stop the sheet feeding. Numeral 204 denotes the sheet feed rollers for feeding a leading edge of the sheet S up to the shutter 227. Numeral 203 denotes a manual sheet feed clutch for feeding the recording sheet S put on a manual sheet feed tray 202 up to the shutter 227. Numeral 233 denotes option sheet feed rollers (i.e., transit sheet feed rollers) for feeding the recording sheet S fed from the sheet feed option device 107 into the printer 102 itself.

The sheet feed option device 107 is composed of the paper deck 241, a paper deck sheet feed roller 242, feed rollers 244, the transit sheet feed rollers 233 and a recording sheet loading amount sensor 241*s*. The paper deck 241 capable of being moved up and down is loaded with a large number of recording sheets S. The paper deck sheet feed roller 242 feeds the recording sheet S on the deck 241. The feed rollers 244 feed the recording sheet S from the roller 242 to the transit sheet feed rollers 233. The rollers 233 transitionally feed recording sheets fed from plural other sheet feed system option units capable of being detachably connected below the sheet feed option device 107. In this case, it should be noted that the other sheet feed system option unit can feed the different-size sheets or the same-size sheets. The recording sheet loading amount sensor 241*s* detects a loading amount of the recording sheets S on the paper deck 241.

A laser scanner unit 206 is composed of a laser unit 215, a polygon mirror 216, an image forming lens group 218, a reflection mirror 219 and a light amount sensor 270. The laser unit 215 generates laser beam on the basis of an image signal (VDO signal) from the video controller 103. The laser beam generated by the laser unit 215 is scanned by the polygon mirror 216 and then introduced onto a photosensitive drum 220 through the lens group 218 and the reflection mirror 219, whereby a latent image is formed on the drum 220. A beam detector 217 detects the laser beam generated from the laser unit 215 and outputs a main-scanning sync signal. The light amount sensor 270 detects a light amount of the laser beam generated from the laser unit 215.

Numeral 205 denotes a pair of resist rollers provided on a downstream side of the manual sheet feed clutch 203, the cassette sheet feed clutch 231 and the transit sheet feed rollers 233 for synchronously feeding the recording sheet S to an image recording unit 207.

The image recording unit 207 is composed of the photosensitive drum 220, a primary charger 222, a development unit 223, a transfer charger 224, a cleaner 225 and a pre-exposure lamp 221. The primary charger 222 uniformly charges the photosensitive drum 220. The development unit 223 develops the latent image formed on the drum 220 by using a toner. The transfer charger 224 transfers the toner image on the drum 220 developed by the development unit 223 to the recording sheet S fed by the resist rollers 205. The cleaner 225 removes the remaining toner on the drum 220. The pre-exposure lamp 221 light discharges the drum 220.

Numeral 208 denotes a fixing unit provided on a downstream side of the image recording unit 207 for heat fixing the toner image on the recording sheet S fed from the unit 207. Numeral 210 denotes feed rollers provided on a downstream side of the fixing unit 208 for feeding and discharging the recording sheet S. Numeral 209 denotes a sheet discharge sensor also provided on the downstream side of the fixing unit 208 for detecting a discharge status of the sheet S.

Numeral 211 denotes a flapper for switching a feeding direction of the sheet S by the feed rollers 210 between a side of a loading tray 213 and a side of the sheet discharge option device 108. Numerals 214 and 212 denote sheet discharge rollers for discharging the recording sheet S guided by the flapper 211 to the loading tray 213. Numeral 213*s* denotes a sheet discharge loading amount sensor for detecting a loading amount of the recording sheets loaded or put on the loading tray 213.

Numerals 251 to 253 denote the sheet discharge trays each capable of loading about 700 sheets. Therefore, about 2000 sheets can be loaded on the three trays in total. In a case where the sheet is subjected to a stapling process, since there is some fear that the loaded sheets break down when the sheet discharge tray is moved up and down, a detection standard of sheet full loading on each sheet discharge tray is set to have a half (44 mm) of an ordinary value (88 mm in this case). Numeral 260 denotes a sheet discharge tray elevation motor for moving the trays 251 to 253 up and down. Numeral 261 denotes a sheet discharge loading amount sensor (i.e., height sensor) for detecting heights of the recording sheets on the trays 251 to 253. For example, at a time when it is detected that the height of the recording sheets on the tray reaches 88 mm (corresponding to about 700 sheets), the finisher controller 108*a* notifies the video controller 103 of "full loading" through the option controller unit 106.

Numeral 259 denotes a stapler. In the stapling designation by the video controller 103 through the integrated interface 90, the recording sheets S are loaded and aligned on a not-shown stapling tray provided in the vicinity of the stapler 259, the stapling is performed by the stapler 259, and then the stapled sheets are discharged to any one of the trays 251 to 253. On the other hand, in a shift designation by the video controller 103 through the integrated interface 90, the sheets S are loaded and aligned on the stapling tray, the sheet discharge trays 251 to 253 are shifted in a horizontal direction (front side of drawing sheet⇆reverse side of drawing sheet), and then the sheets S are discharged to any one of the trays 251 to 253. Numeral 259*s* denotes a stapler stylus remaining amount sensor for detecting a remaining amount of styluses held in the stapler 259.

Figure 14A:
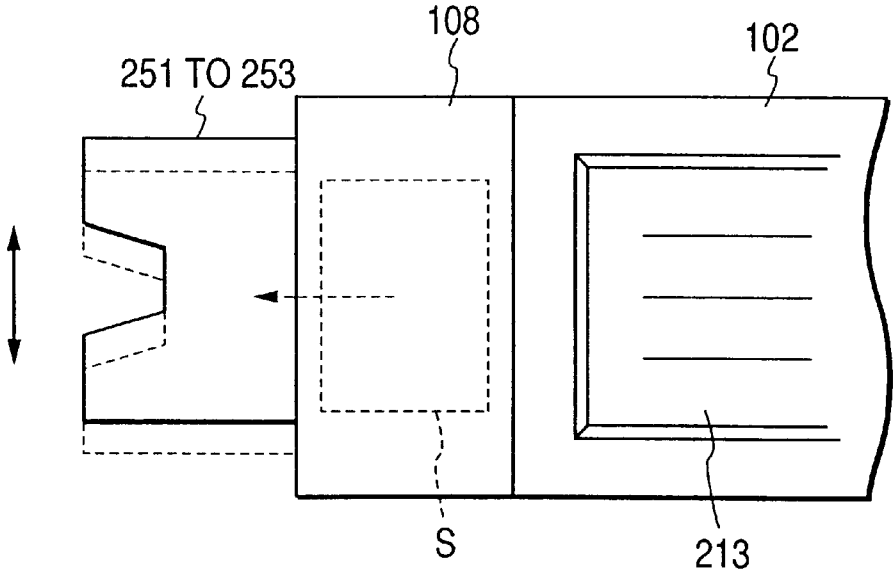
FIGS. 14A and 14B are views for explaining shift sheet discharge.
Figure 14B:
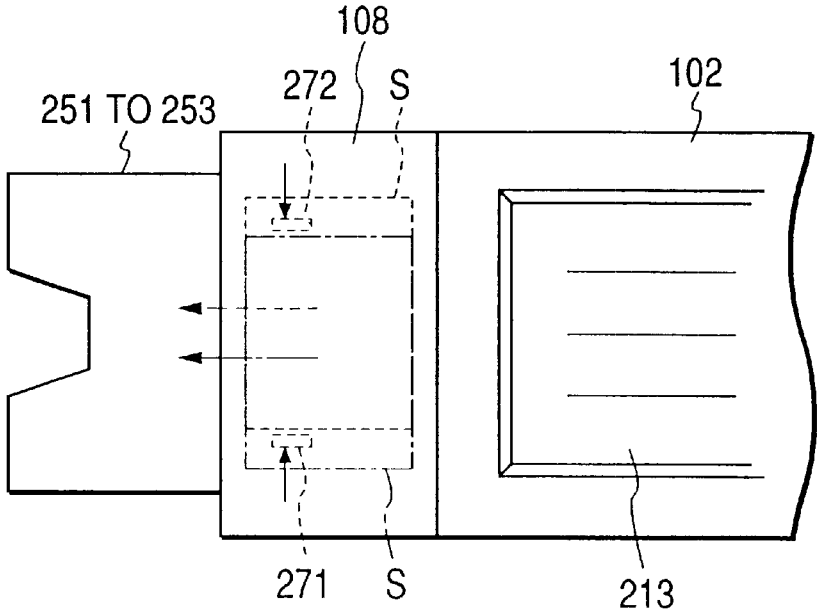

FIGS. 14A and 14B are views for explaining a shift sheet discharge operation to be performed according to shift designation, and are plan views of the sheet feed option device 108 and the laser beam printer 102. FIG. 14A shows a shift sheet discharge mechanism in the present embodiment. For example, when the shift sheet discharge is designated in a status that the sheet discharge trays 251 to 253 are at a solid-line position, the trays 251 to 253 are shifted to a dashed-line position by driving a not-shown motor. Thus, a stack of sheets is put or loaded on the tray in a status that the stack is being shifted from its original position. On the other hand, when the shift sheet discharge is designated in the status that the trays 251 to 253 are at the dashed-line position, the trays 251 to 253 are shifted to the solid-line position. Further, when the shift sheet discharge is not designated, the position of the trays 251 to 253 in the horizontal direction are maintained as it is, and any tray is not shifted.

FIG. 14B shows an another type of a shift sheet discharge mechanism. When the tray to which the sheet is intended to be discharged is vacant, or when the shift sheet discharge is not designated, the sheet is once shifted to a dashed-line position by an alignment member 271 and then discharged onto the tray. On the other hand, when the shift sheet discharge is designated and the sheet already discharged in a previous-time job remains at the dashed-line position on the tray, the sheet to be discharged in a present-time job (current job) is once shifted to an alternate long and short dashed-line position and then discharged onto the tray.

Further, when the shift sheet discharge is designated and the sheet already discharged in the previous-time job remains at the alternate long and short dashed-line position on the tray, the sheet to be discharged in the present-time job is once shifted to the dashed-line position by the alignment member 271 and then discharged onto the tray.

Figure 5:
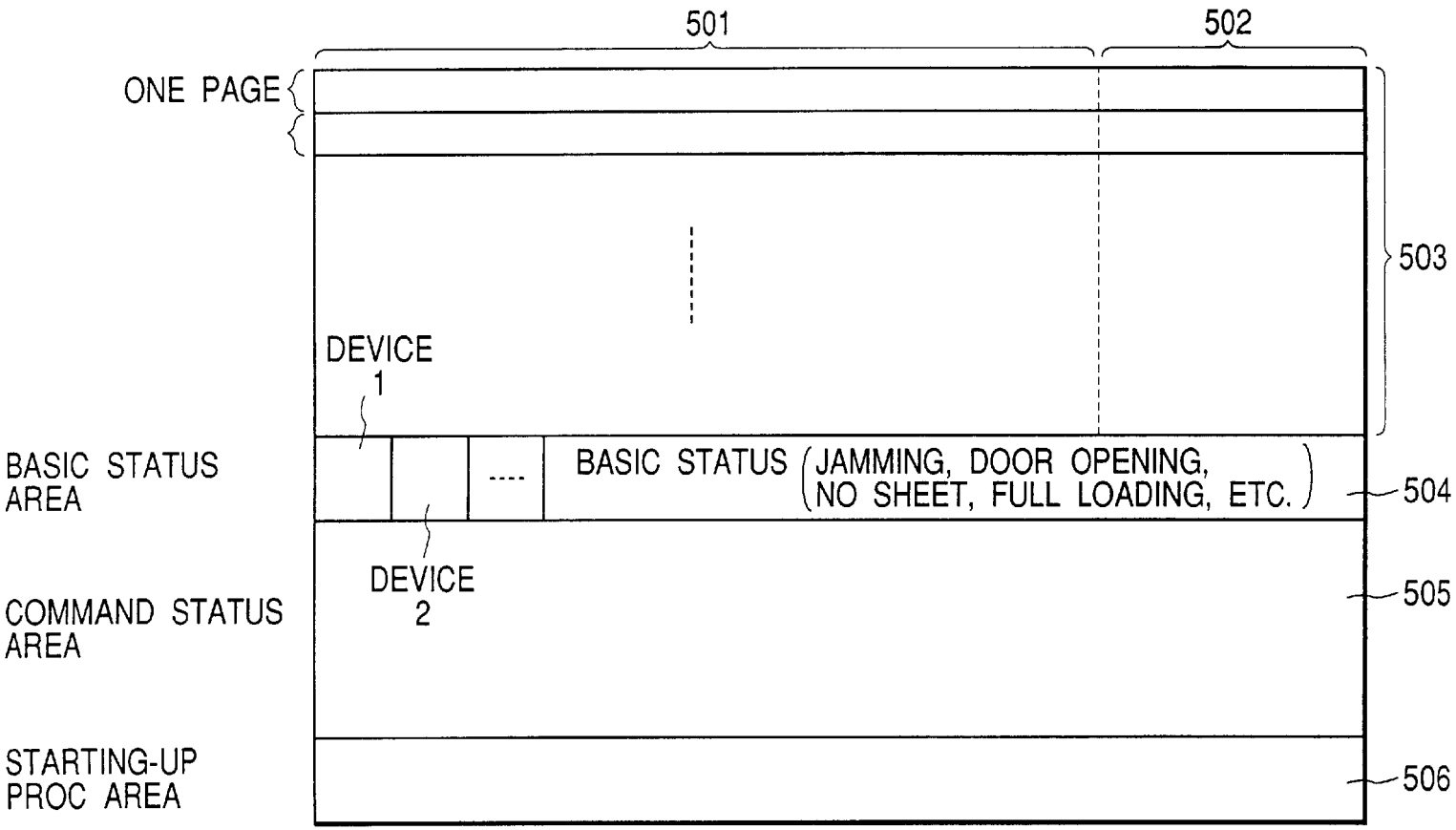
FIG. 5 is a view showing an example of a memory map in a common memory of a RAM in an option controller unit 106 shown in FIG. 1.
Figure 6:
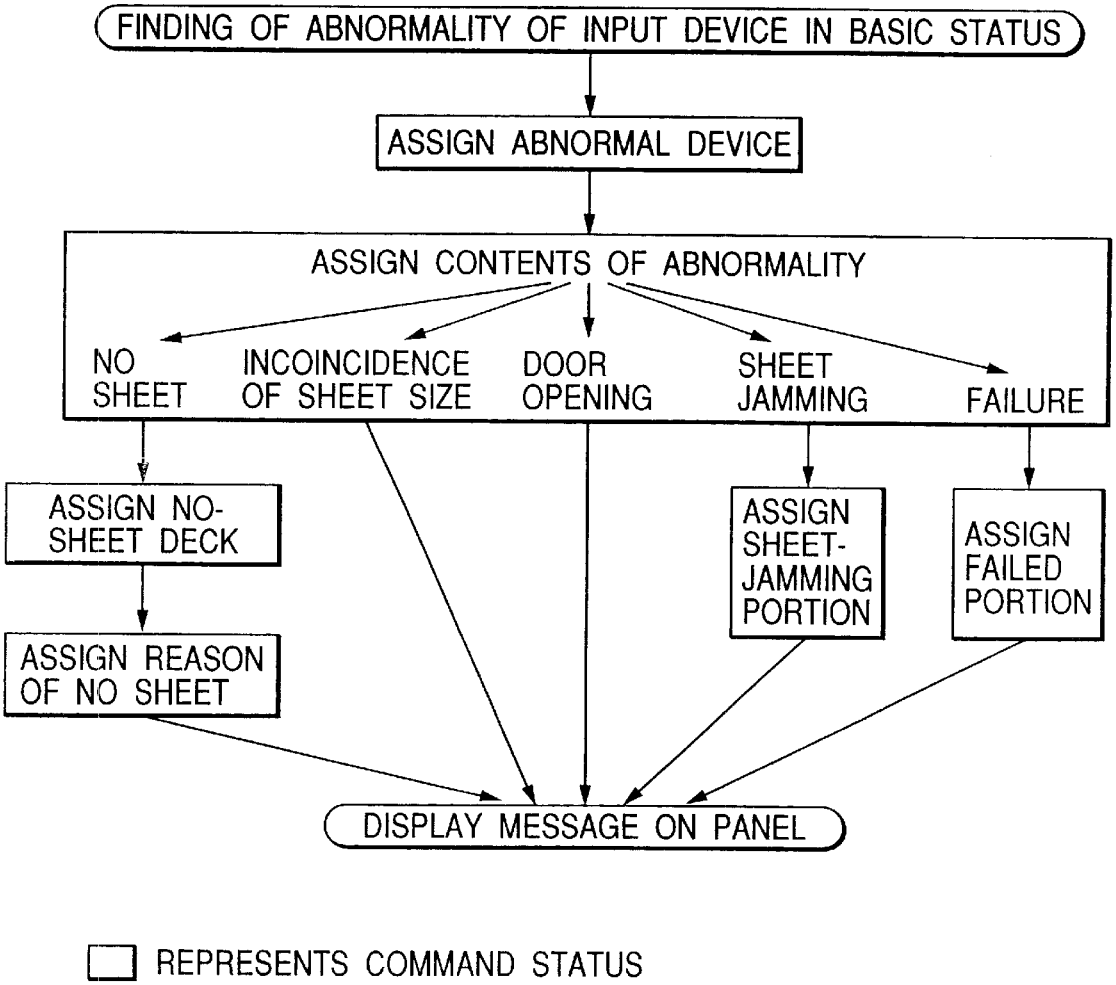
FIG. 6 is a view for explaining an example that, based on a basic status, a command status is generated to acquire detailed information of input and output options.
Figure 7:
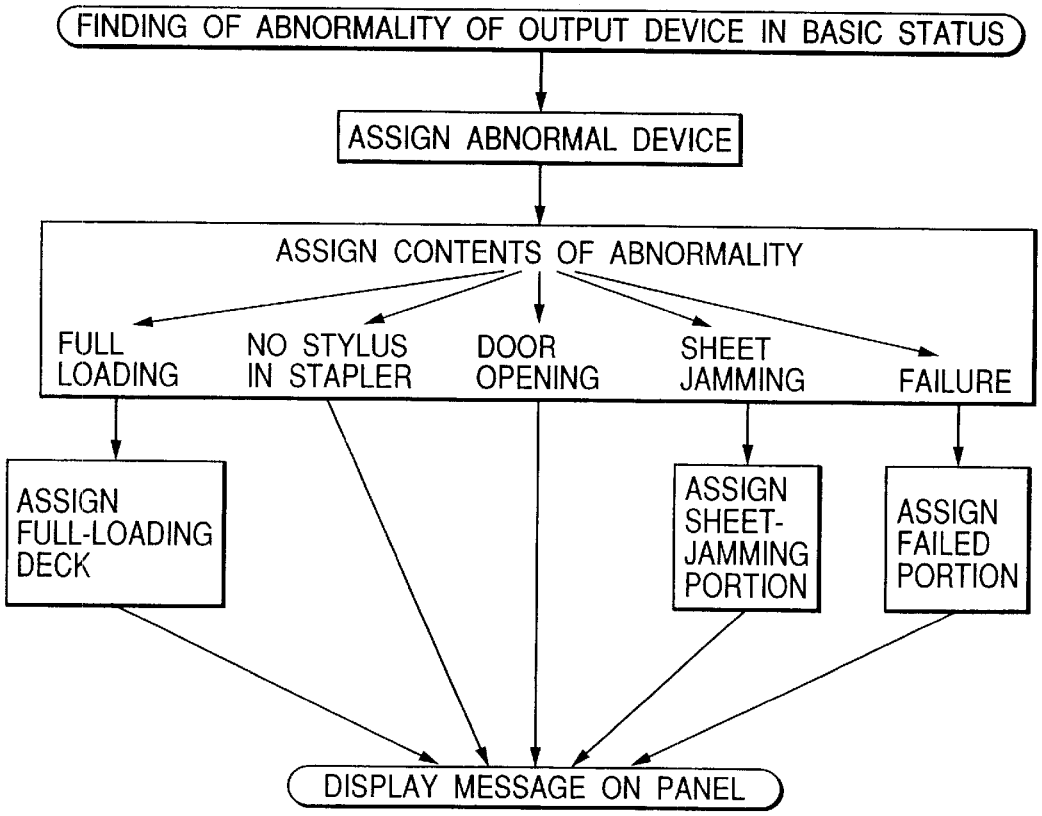
FIG. 7 is a view for explaining an example that, based on the basic status, the command status is generated to acquire the detailed information of the input and output options.

Subsequently, a method in which the video controller 103 integrally or entirely controls the respective option devices through the option controller unit 106 will be explained with reference to FIGS. 5 to 7. The common memory shown in FIG. 5 is composed of a feed status management area 503 used to perform page designation and to know a sheet feed status, a basic status area 504 used to know an abnormal status of each option device, a command status area 505 used to manage a command status, and a starting-up process area 506 used to designate a starting-up process of the option device.

The starting-up process area 506 is composed of a starting-up designation part used when the video controller 103 designates the starting-up process, and a completion notification part used when each option device notifies the controller of completion of the process as a result of the above designation. When the video controller 103 designates the starting-up process by using the area 506, each option device performs the starting-up process. That is, when a power supply is turned on, the video controller 103 notifies the starting-up designation part of initialization designation of the common memory, configuration information acquisition designation for each option device necessary in the option controller unit 106, information acquisition completion, and the like, and then observes the completion notification part to check whether or not each process is completed. When all the processes are completed, the starting-up process terminates.

The feed status management area 503 is composed of a part used to designate various print methods such as the sheet feed tray, the sheet discharge tray, color/monochrome printing, a stapling position, execution of stapling, and the like, and a part used to know various statuses of options such as where the fed sheet has reached, whether print signal outputting is allowed, whether sheet discharging has been completed, and the like. The video controller 103 designates the above print methods and grasps the status of each option to perform the printing.

It is possible to perform the designation of maximumly 40 pages in the feed status management area 503. The designation is performed for each page in due order. Then, the area from which the corresponding page (i.e., data) has been discharged is considered as a vacant area and initialized for redesignation. Thus, the initialized area is used as a ring buffer.

The basic status area 504 is the area used when the abnormal status of each option device is notified. That is, the video controller 103 acquires the abnormal statuses such as no sheet, sheet jamming, door opening, full loading and the like. Further, the controller acquires more detailed information from the contents of a basic status by managing the command status.

The command status area 505 is the area used to acquire the detailed information of each option and perform operation controlling of the option. That is, the video controller 103 designates the necessary command in this area and acquires the information. For example, the information concerning a device name, a size of the actually fed sheet, a remaining amount of the sheets for feeding, a sheet-jamming position, a kind of sheet jamming, an access point, a loading amount of the discharged sheets, details of failure and the like can be acquired. As shown in FIGS. 6 and 7, the controller generates the command according to respective situations and receives the status. Further, options such as mode changing to a power saving mode, emergency stop at the time when the sheet jamming occurs, shift of the sheet discharge tray, execution of reset, and the like are controlled by using the command status area 505.

As above, the video controller 103 acquires the above various information, and thus the printer 102 performs the printing in the status of no abnormality. When the controller 103 detects the abnormality from the basic status area, it generates the command status to assign (or specify) the abnormal point, assigns the contents of the abnormality in the device, collects the detailed information according to such an abnormality, and then controls the device based on the collected information.

Figure 8:
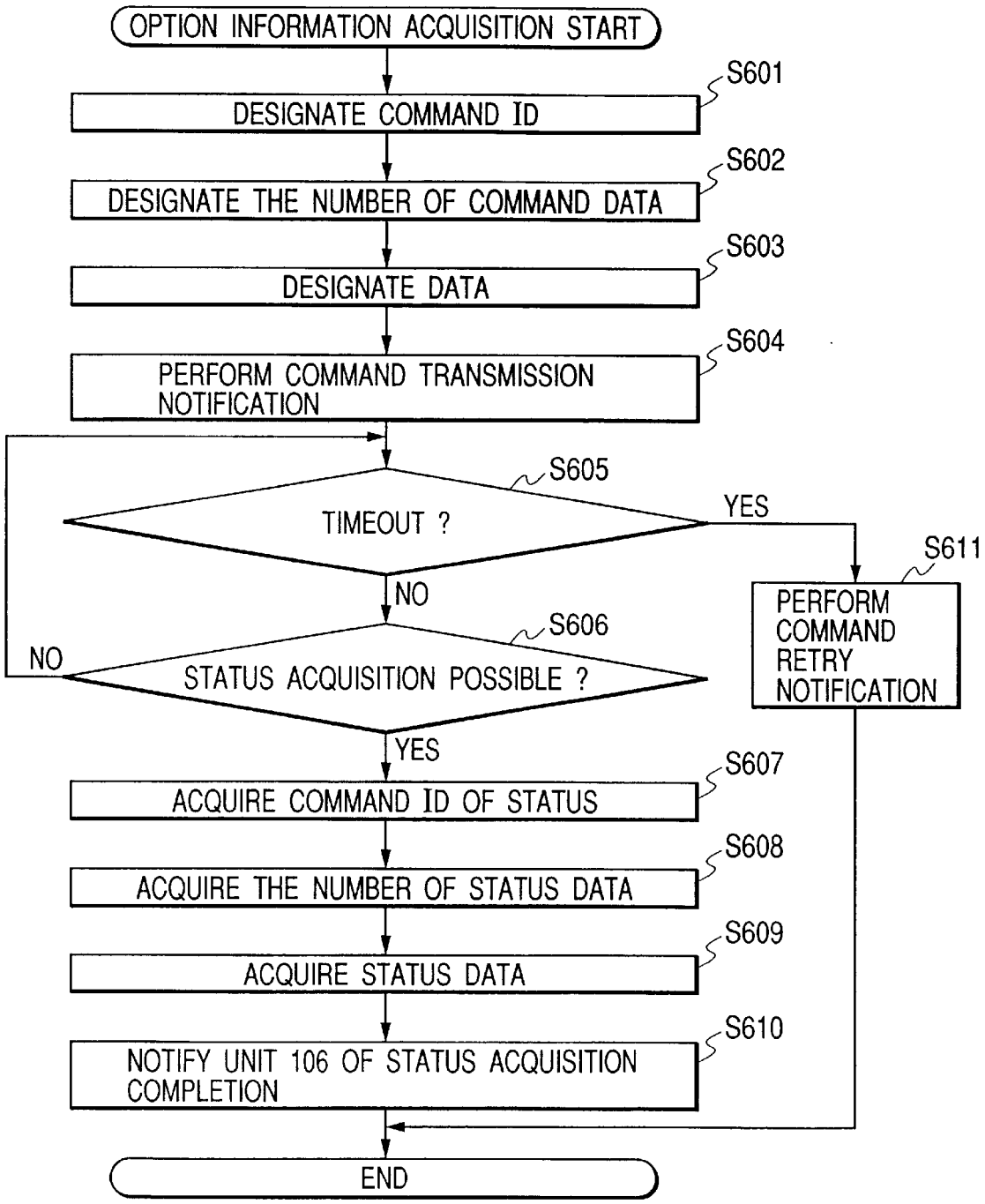
FIG. 8 is a flowchart showing an example of option information acquisition procedure by a control unit 109 shown in FIG. 1.

FIG. 8 is a flowchart showing an example of control procedure by the control unit 109. In this example, the control unit 109 accesses to the common memory in the option controller unit 106, and sends and receives the command status to/from each option to exchange the information. In the case of acquiring the option information, the control unit 109 performs the designation in the command status management area in the common memory and receives the information. That is, the control unit 109 designates ID (identification) to discriminate the kind of necessary information at a predetermined address in a command designation area (S601), designates at the predetermined address the number of data to be designated to the option controller unit 106 according to an execution command (S602), designates the data representing the designated contents at the predetermined address (S603), notifies the unit 105 that the command was sent, and then pulls the trigger such that the unit 106 manages the command status to/from each option device to acquire the information (S604). According to this trigger and the designated contents, the unit 106 performs a serial communication with the necessary option device to obtain the designated information.

On the other hand, the control unit 109 operates a tune until the option controller unit 106 completely acquires the information, to observe whether or not the video controller 103 is in a status capable of acquiring the status information (S605, S606). If the controller 103 does not come to be in such a status after elapsing a predetermined time, the unit 109 can not acquire the status information. Therefore, the unit 109 sends a retry notification to the controller 103 for command re-execution (S611), and the process terminates.

If the controller 103 comes to be in the status capable of acquiring the status information, the unit 109 acquires the command ID of the status and confirms whether or not the status information corresponds to the designated command (S607). Then, the unit 109 acquires the number of status data (S608), acquires the status data to such the number (S609), and then notifies the option controller unit 106 of status acquisition completion (S610).

Figure 10:
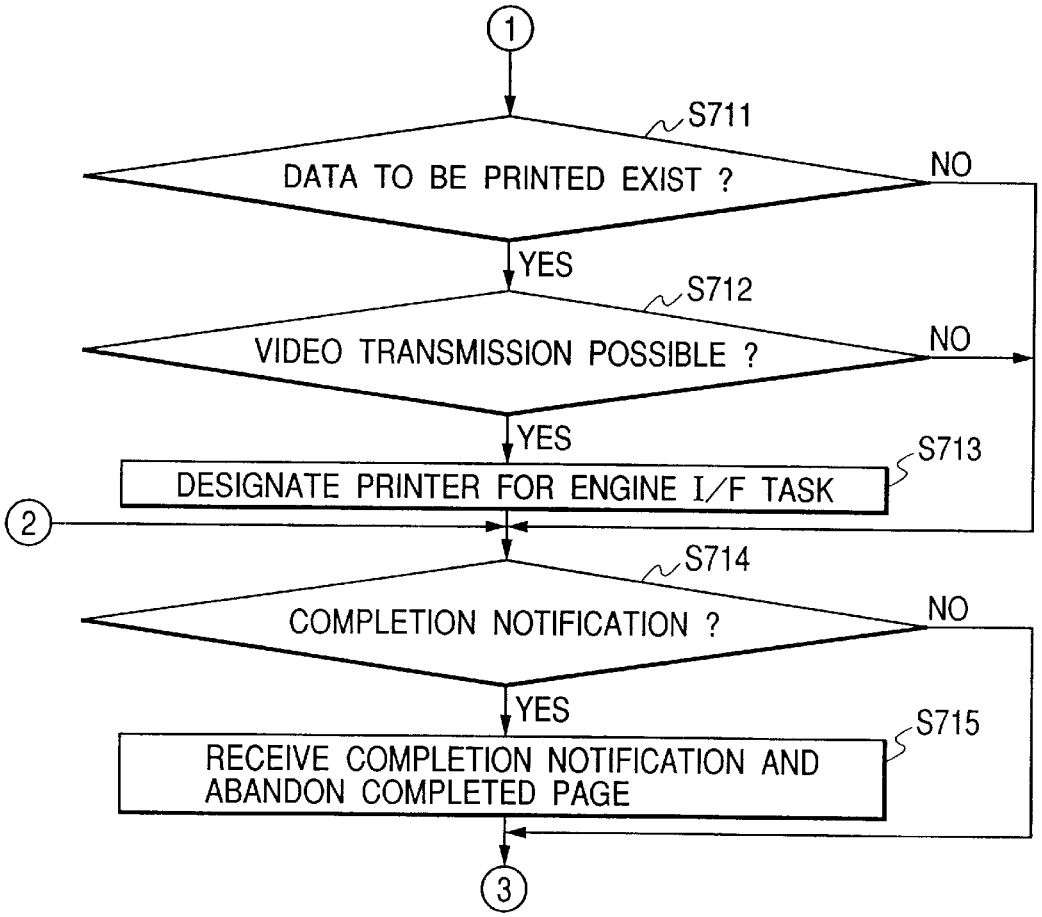
FIG. 10 is a flowchart showing the example of the scheduling procedure by the control unit 109 shown in FIG. 1.

FIGS. 9 and 10 are flowcharts showing an example of scheduling procedure by the control unit 109 shown in FIG. 1. This example relates to the process procedure of a scheduling system which performs scheduling according to command information analyzed and converted by a translator process system, on the basis of the control data and the print data sent from the external equipment 101. That is, when the data is sent from the external equipment 101, the process procedure starts. Initially, it is observed whether or not the sent data includes the print data, the unit 109 produces the page information and the print information based on designation contents of a layout command (S702), and determines the sheet feed and discharge ports (i.e., trays) from the formed page information (S703). Since the designation contents in the step S702 include "auto", the sheet feed and discharge ports cannot be finally determined in this step. In the step S703, the fixed sheet feed port (tray) is determined based on sheet presence/absence, sheet size and the like, while the fixed sheet discharge port (tray) is determined based on whether the sheet can be loaded and the like.

When the sheet feed and discharge ports are determined, it is judged whether or not a sheet discharge mode in a present-time job (current job) is different from that in a previous-time job (S704). If different, since an another job is processed, the information of the sheet discharge port is detected (S711). Further, it is judged whether or not the sheet remains in the sheet discharge port (S708), to check whether or not the shift sheet discharge is necessary. On the other hand, if not different, it is further judged whether or not it is necessary to shift (or change) the sheet discharge port to the port to which the sheet is discharged next (S705). If necessary, a sheet discharge port shift command is generated to previously set the next-used sheet discharge port to be in a current status, thereby detecting sheet loading information or the like of the current sheet discharge port (S706).

Subsequently, it is judged whether the designated sheet discharge mode is an automatic sheet discharge mode or a fixed sheet discharge mode (S707). In case of the automatic sheet discharge mode, it is judged whether or not the sheet remains in the shifted or changed sheet discharge port intended to be used for sheet discharging (S708). If the sheet remains, it is necessary to notify the user that there is some fear that the sheet discharge port is changed during the job and thus the sheets of the plural jobs are undesirably mixed to others. To do so, it is judged whether or not the shift sheet discharge is to be performed, and the designation is changed to perform the shift sheet discharge according to necessity (S709). In this case, in order to prevent a phenomenon that the sheet of the another job invades and is irregularly loaded, a message "remove sheet" may be displayed to urge the user to remove the unnecessary sheet.

On the other hand, if the sheet does not remain in the sheet discharge port, since the sheet of the another user's job does not invade, the sheet is discharged as it is. Therefore, the unit 109 performs print designation in the common memory of the option controller unit 106 through the option unit interface (S710).

On the other hand, if the sheet discharge mode designated is the fixed sheet discharge mode, since the shift or change of the sheet discharge port occurs only by the designation at the head of job, another user's job never invades during a job being carried on. For this reason, even if the sheet remains, any message is not displayed, and the sheet is output as it is. Therefore, the unit 109 performs the print designation in the common memory of the option controller unit 106 through the option unit interface (S710). For this reason, even if the sheet remains, any message is not displayed, and the sheet is output as it is. Therefore, the unit 109 performs the print designation in the common memory of the option controller unit 106 through the option unit interface (S710).

Then, it is judged whether or not the page not yet printed remains although the page information and the print information have been already formed (S711). If remains, it is further judged whether or not the engine controller 105 is in a ready status and a status capable of performing video transmission (S712). If in such the video transmittable status, the print designation is performed for a later-described engine interface task shown in FIG. 8 (S713). Further, the engine interface task performs the print designation to the engine controller 105. Subsequently, it is observed whether or not a sheet discharge completion notification of the page to which the printing started is received (S714). When the sheet discharge completion notification is received, the information of the completed page is abandoned, and the status of the designated page is updated to make vacancy in the memory (S715). After then, the flow returns to the reception judgment process in the step S701.

On the other hand, if it is judged in the step S711 that there is no data to be printed, the flow advances to the step S714.

Further, if it is judged in the step S712 that the engine controller 105 is not in the video transmittable status, the print designation to the engine interface task is not performed, and the flow advances to the step S713.

If the print data to be scheduled is not newly sent after designating only the one-page print data, the judgment in the step S715 is repeated to update only the status representing that the page already designated is in what status.

Further, in such a case as the print data of a plurality of pages are received and thus the continuous printing is performed, ordinarily the print designation is performed to the engine controller 105 in the status that the print designation for two or three later pages is performed to the option controller unit 106, so as to increase a thruput. After repeating the processes in the steps S702 to S709, the process by the engine interface task starts.

Figure 11:
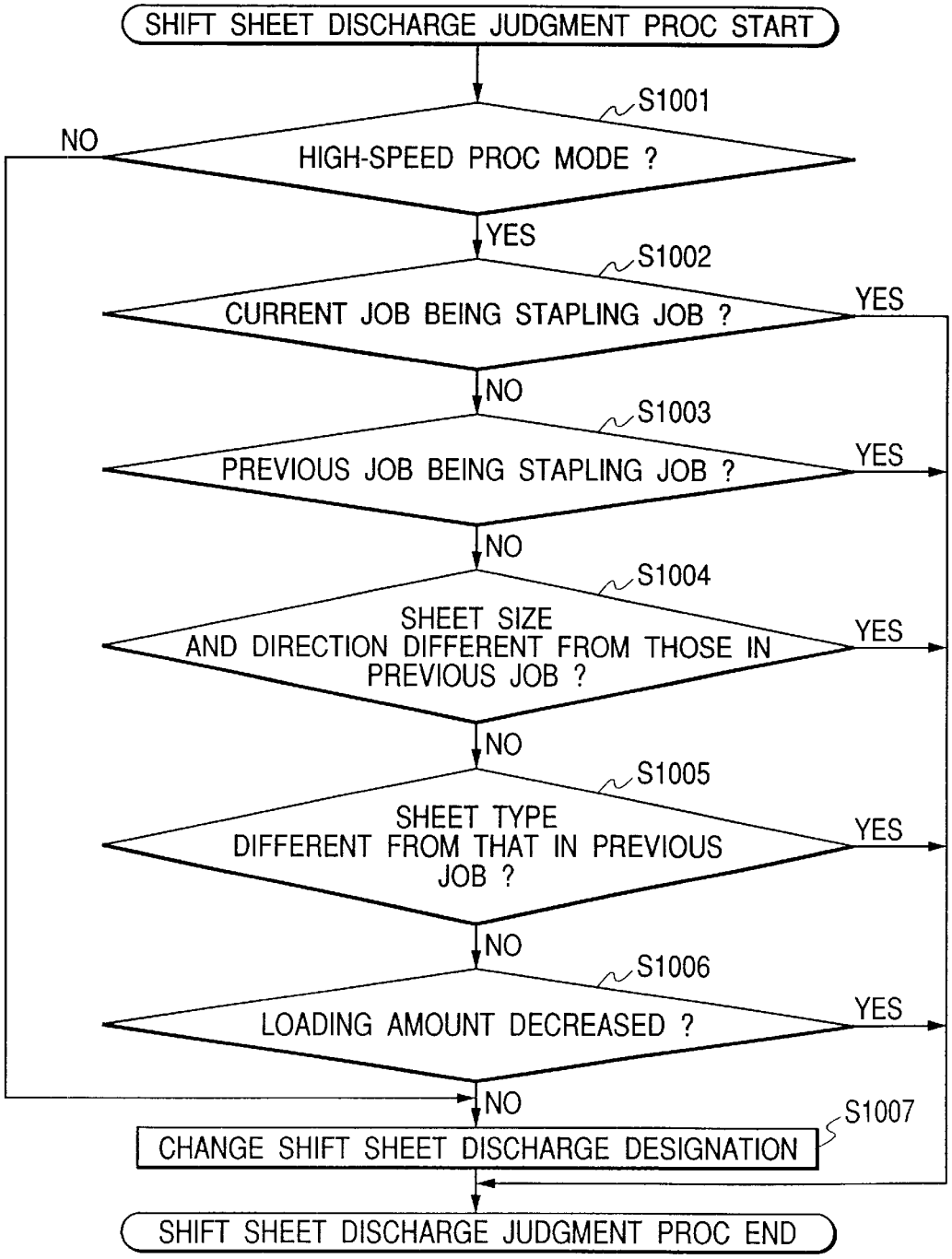
FIG. 11 is a flowchart showing an example of procedure of a shift sheet discharge judgment process in a step S708 of FIG. 9.

FIG. 11 is a flowchart showing an example of procedure in such a shift sheet discharge judgment process as in the step S708 of FIG. 9. Initially, it is judged whether or not a process mode which can be set by a panel (console) operation or the like and is acquired from an external storage device such as an NVRAM or the like is a high-speed process mode in which any unnecessary job is not mixed (S1001). If so, it is checked how a loading status in the sheet discharge port used for sheet discharging, a sheet discharge mode and the like are set, so as to judge whether or not the shift sheet discharge is to be performed.

That is, it is judged whether or not the current job is designated to be subjected to the stapling process (S1002). If not, the shift sheet discharge judgment process terminates. On the other hand, if the stapling process is designated, it is further judged whether or not the previous-time job was the stapling job (S1003). If not, the shift sheet discharge judgment process terminates. On the other hand, if the stapling job is designated, it is further judged whether or not the sheet size or direction in the previous-time (current) job (S1004). If different, the shift sheet discharge judgment process terminates. If it is not different, it is further judged whether or not a sheet type (i.e., color, material or the like) in the previous-time job (S1005). If different, the shift sheet discharge judgment process terminates. If it is not different, it is further judged whether or not the sheet loading amount at the present-time sheet discharging is smaller than that at the previous-time sheet discharging because the user has removed the sheet in the sheet discharge port (S1006). If smaller, the shift sheet discharge judgment process terminates. If it is not smaller, a process to change the designation into the shift sheet discharge designation is performed (S1007). In other words, in a case where a condition that it becomes impossible to discriminate a pause or boundary between the previous- and present-time jobs when the shift sheet discharge is not performed is satisfied, the process in the step S1007 is performed.

If it is judged that the high-speed process mode is not set in the step S1001, the flow advances to the step S1007.

If there is a "YES" determination in any one of the steps S1002 to S1006, the designation is not forcedly changed into the shift sheet discharge designation. Rather the sheet is discharged based on the essential designation from the external equipment 101 or the like. When this is a "YES" determination in any one of the steps S1002 to S1006, the user can easily discriminate the pause or boundary of the jobs even if the shift sheet discharge is not performed.

Figure 12:
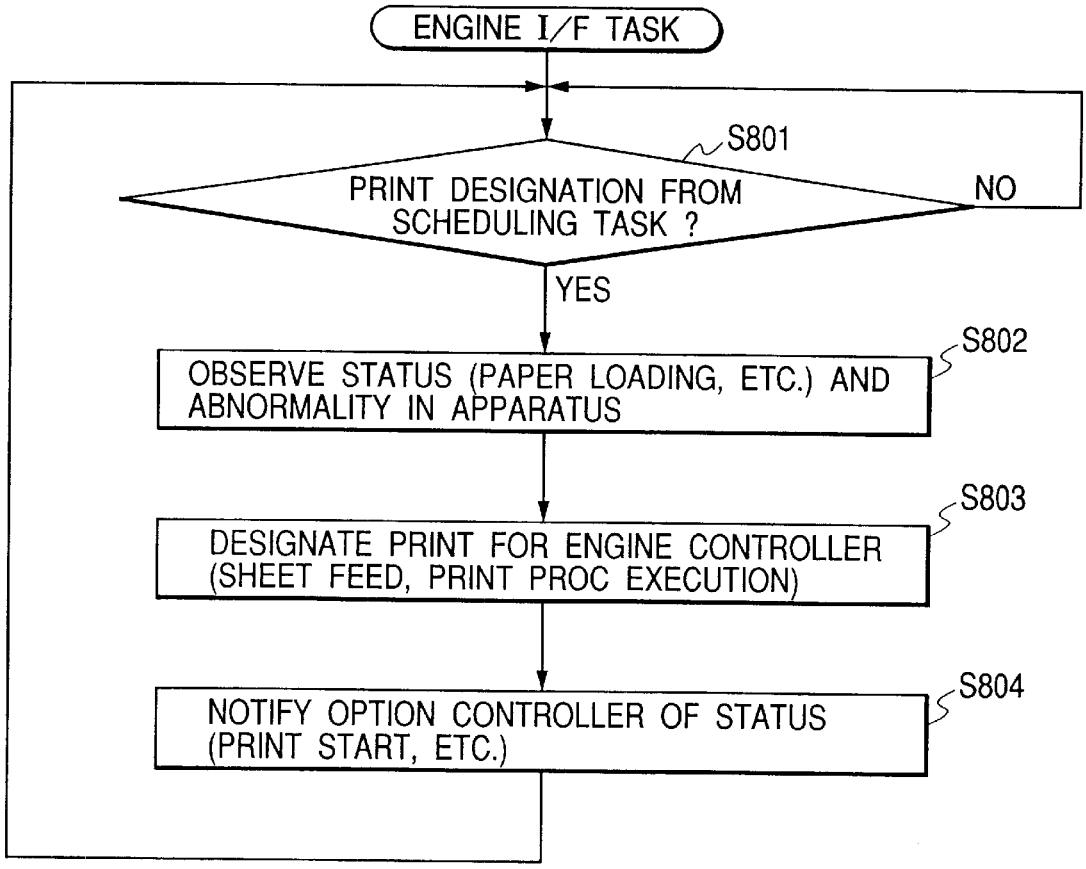
FIG. 12 is a flowchart showing an example of print execution procedure by the control unit 109 shown in FIG. 1.

FIG. 12 is a flowchart showing an example of the print execution procedure by the control unit 109 shown in FIG. 1. This example is directed to the process procedure of an engine interface system which executes the printing based on page information formed by the scheduling system. The engine interface system is initiated based on the print designation from a page scheduling system. Initially, if there is the print designation from a scheduling task (S801), status observation (i.e., possibility of printing, sheet size and the like), abnormality observation (no sheet, door opening, sheet jamming and the like) and the like of the print 102 itself are performed (S802), and the observed results are notified to the necessary systems. Then, the print designation is performed to the engine controller 105 through the engine interface unit 406, to perform the print process (S803). Further, a status notification such as sheet feed starting, print starting and the like is sent to the option controller unit 106 through the option interface unit 412 (S804). After then, the flow returns to the step S801.

Figure 13:
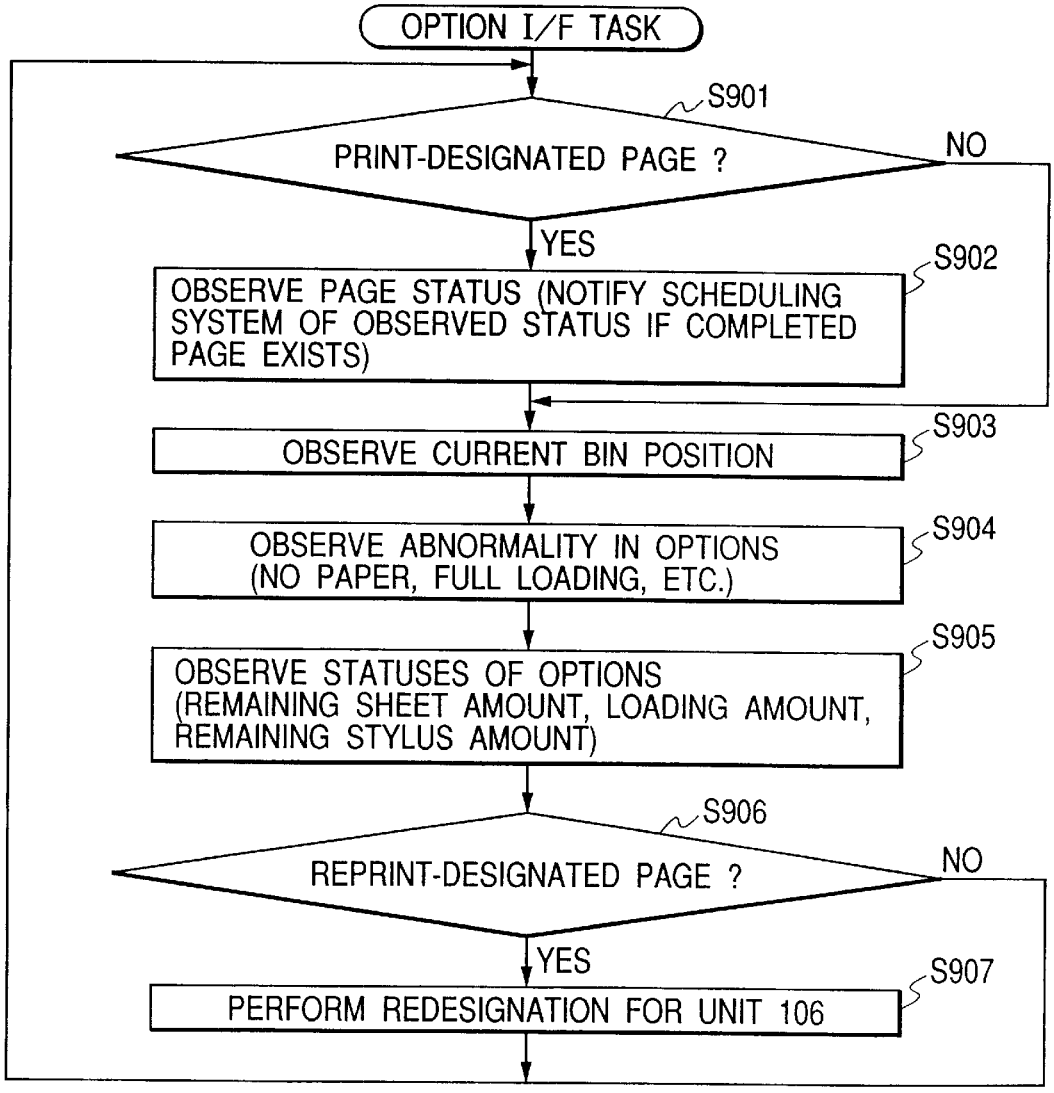
FIG. 13 is a flowchart showing an example of process procedure by the control unit 109 shown in FIG. 1 in a case where a redesignation notification is sent to the option controller unit 106.

FIG. 13 is a flowchart showing an example of process procedure by the control unit 109 shown in FIG. 1 in a case where a redesignation notification is sent to the option controller unit 106. This example is directed to the process procedure of an option interface system which observes the status of the page designated by the scheduling system and notifies the option controller unit 106 of the information redesignated by the engine interface system and other systems. That is, it is initially judged whether or not the page print-designated by the scheduling system is present or exists (S901). If present, the status of this page is observed (S902). At this time, if the page already printed is present, the control unit 109 notifies the scheduling system that the corresponding information can be abandoned. Then, a position of an optional movable-type sheet discharge port (including whether or not port is in shifting) is observed (S903). On the other hand, if the page print-designated is not present, the page status is not observed, and the flow advances to the step S903.

Subsequently, an abnormality such as no sheet in the options, sheet jamming, full loading and the like is observed (S904). The unit 109 notifies the necessary systems of the observed results to instruct them to perform operator call displaying, execution of redesignation and the like. Then, for example, the statuses such as the sheet remaining amount in the feed port, the sheet loading amount in the discharge port, the stapling stylus remaining amount and the like are observed and updated (S905). After that, a redesignation notification is received from the engine interface system or the like, and thus it is judged whether or not there is the redesignation data present (S906). If there is no redesignation data present, the flow returns to the step S901. On the other hand, if there is the redesignation data present, the redesignation is performed to the option controller unit 106 on the basis of the redesignation data (S907). The engine interface system performs the print process according to such a redesignation.

Such a redesignation is performed by reason of, e.g., change of the sheet feed port due to no sheet status, change of the sheet discharge port due to full loading status, or the like. In this case, the designation is switched to the redesignation.

(Second Embodiment)

The second embodiment is different from the first embodiment regarding a process to be performed when a sheet remains in a sheet discharge port after port shifting. In the first embodiment, the job is sectioned from others through the shift sheet discharge operation, thereby preventing that the user erroneously picks up the discharged sheet. Such a shift sheet discharge operation is not performed in the present embodiment. Instead, a message such as "remove sheet" or the like is displayed to urge the user to remove the loaded sheet such that any unnecessary job is not mixed with the current job. Therefore, as compared with a conventional case, the number of displays urging the user to remove the sheet can be reduced.

(Third Embodiment)

In a case where a sheet remains in a sheet discharge port after port shifting, the job is sectioned by the shift sheet discharge operation in the first embodiment, while an on-line status is shifted to an off-line status and the message such as "remove sheet" or the like is displayed to urge the user to remove the loaded sheet in the second embodiment. However, in the third embodiment, the user can set either of the shift sheet discharge operation and the operation that the message such as "remove sheet" or the like is displayed to urge the user to remove the loaded sheet. Therefore, it becomes possible to select one of these two operations according to the user's setting, so that the number of displays urging the user to remove the sheet can be reduced as compared with the conventional case.

What is claimed is:

1. A sheet processing apparatus comprising:

binding process means for performing a binding process of sheets in a binding job;

shift sheet discharging means for performing a shift discharge of a sheet such that the sheet to be discharged on a tray is stored in a shifted position with respect to a sheet of an immediately preceding job already stored on the tray; and control means for controlling, in a case where a current job to be processed after the immediately preceding job is a nonbinding job, said shift sheet discharging means to permit a shift discharge of a sheet of the current job by said shift sheet discharging means when the immediately preceding job in a nonbinding job, and to inhibit a shift discharge of a sheet of the current job if the immediately preceding job is a binding job.

2. An apparatus according to claim 1, wherein the immediately preceding job is a job already processed, and the current job is a job in which processing has not ended, and said control means includes discrimination means for discriminating whether the immediately preceding job is the binding job and discrimination means for discriminating whether the current job is the binding job.

3. An apparatus according to claim 1, wherein said shift sheet discharging means includes tray shift means for shifting the tray in a horizontal direction to perform the shift discharge.

4. An apparatus according to claim 3, wherein said tray shift means shifts the tray in a direction perpendicular to a sheet discharge direction.

5. An apparatus according to claim 1, wherein said shift sheet discharging means includes shift means for shifting the sheet in a horizontal direction to perform the shift discharge before storing the sheet on the tray.

6. An apparatus according to claim 5, wherein said shift means shifts the sheet in a direction perpendicular to a sheet discharge direction.

7. An apparatus according to claim 1, wherein said shift sheet discharging means discharges the sheet to any one of a plurality of trays.

8. An apparatus according to claim 1, further comprising image forming means for forming an image on the sheet.

9. An apparatus according to claim 1, wherein said shift sheet discharging means performs the shift discharge of the sheets of one of the immediately preceding or current job, which is composed of a plurality of sheets.

10. A controller for controlling a sheet processing apparatus comprising:

binding process means for performing a binding process of sheets in a binding job; and shift sheet discharging means for performing shift a discharge of a sheet such that the sheet to be discharged on a tray is stored in a shifted position with respect to a sheet of an immediately preceding job already stored on the tray, said controller comprising:

control means for controlling, in a case where a current job to be processed after the immediately preceding job is a nonbinding job, said shift sheet discharging means to permit a shift discharge of a sheet of the current job by said shift sheet discharge means when the immediately preceding job is a nonbinding job, and to inhibit the shift discharge of a sheet of the current job if the immediately preceding job is a binding job.

11. An apparatus according to claim 10, wherein said shift sheet discharging means includes tray shift means for shifting the tray in a horizontal direction to perform the shift discharge.

12. A controller according to claim 11, wherein said tray shift means shifts the tray in a direction perpendicular to a sheet discharge direction.

13. An apparatus according to claim 10, wherein said shift sheet discharging means includes shift means for shifting the sheet in a horizontal direction to perform the shift discharge before storing the sheet on the tray.

14. An apparatus according to claim 13, wherein said shift means shifts the sheet in a direction perpendicular to a sheet discharge direction.

15. A controller according to claim 10, wherein said shift sheet discharging means discharges the sheet to any one of a plurality of trays.

16. A controller according to claim 10, further comprising image forming means for forming an image on the sheet.

17. A controller according to claim 10, wherein said shift sheet discharging means performs the shift discharge of the sheets of one of the immediately preceding or current job, which is composed of a plurality of sheets.

18. A sheet processing method comprising the steps of:

judging whether an immediately preceding job to be processed is a binding job;

judging whether a current job to be processed after the immediately preceding job is a binding job;

performing a shift discharge of a sheet of the current job such that the sheet of the current job to be discharged on a tray is stored in a job to be discharged is being shifted position with respect to a sheet of the immediately preceding job; and controlling, in a case where the current job is a nonbinding job, said shift discharge performing step to permit a shift discharge of the sheet of the current job if the immediately preceding job is a nonbinding job, and to inhibit a shift discharge of the sheet of the current job if the immediately preceding job is a binding job.

19. A method according to claim 18, wherein the immediately preceding job is a job already processed, and the current job is a job in which processing has not ended, and said controlling step includes a discrimination step of discriminating whether the immediately preceding job is the binding job and a discrimination step of discriminating whether the current job is the binding job.

20. A method according to claim 18, wherein said shift sheet discharge step includes a step of shifting the tray in a horizontal direction to perform the shift sheet discharging.

21. A method according to claim 20, wherein said tray shift step shifts the tray in a direction perpendicular to a sheet discharge direction.

22. A method according to claim 18, wherein said shift sheet discharge step includes a step of shifting the sheet in a horizontal direction to perform the shift sheet discharging before putting the sheet on the tray.

23. A method according to claim 22, wherein said sheet shift step shifts the sheet in a direction perpendicular to a sheet discharge direction.

24. A method according to claim 18, wherein said shift sheet discharging step discharges the sheet to any one of a plurality of trays.

25. A method according to claim 18, further comprising a step of forming an image on the sheet.

26. A method according to claim 18, wherein said shift sheet discharging step performs the shift discharge of the sheets of one of the immediately preceding or current job, which is composed of a plurality of sheets.

27. A control method for a sheet processing apparatus, said apparatus including:

a binding process means for performing a binding process of sheets in a binding job; and a shift sheet discharging means for performing shift discharge of a sheet such that the sheet to be discharged on a tray is stored in a shifted position with respect to a sheet of an immediately preceding job already stored on the tray, said method comprising the step of:

controlling, in a case where a current job to be processed after an immediately preceding job is a nonbinding job, the shift sheet discharging means to permit the shift discharge of a sheet of the current job if the immediately preceding job is a nonbinding job, and to inhibit the shift discharge of a sheet of the current job if the immediately preceding job is a binding job.

28. A method according to claim 27, wherein the shift sheet discharging means includes a means for shifting the tray in a horizontal direction to perform the shift discharge.

29. A method according to claim 28, wherein the tray is shifted in a direction perpendicular to a sheet discharge direction.

30. A method according to claim 27, wherein the shift sheet discharging means includes a means for shifting the sheet in a horizontal direction to perform the shift discharge before storing the sheet on the tray.

31. A method according to claim 30, wherein the sheet is shifted in a direction perpendicular to a sheet discharge direction.

32. A method according to claim 27, wherein the shift sheet discharging means discharges the sheet to any one of a plurality of trays.

33. A method according to claim 27, further comprising a step of forming an image on the sheet.

34. A method according to claim 27, wherein the previous job is a job already processed, and the current job is a job in which processing has not ended, and said controlling step includes a discrimination step of discriminating whether the immediately preceding job is the binding job and a discrimination step of discriminating whether the current job is the binding job.

35. A method according to claim 27, wherein said shift sheet discharging means performs the shift discharge of the sheets of one of the immediately preceding or current job, which is composed of a plurality of sheets.

36. An apparatus including shift sheet discharging means for performing a shift discharge of a sheet such that the sheet to be discharged is shifted with respect to a sheet of an immediately preceding job already stored on a tray, said apparatus comprising:

control means for controlling execution/nonexecution of the sheet discharge of a sheet of a current job by the shift sheet discharging means, on a basis of a size of a sheet of the immediately preceding job and a size of the sheet of the current job processed after the immediately preceding job.

37. An apparatus according to claim 36, wherein when a size of the sheet of the current job is similar in size of the sheet of the immediately preceding job, the control means performs a control to permit the shift discharge of the sheet of the current job by said shift sheet discharging means, and when the size of the sheet of the current job is different from the size of the sheet of the immediately preceding job, the control means performs a control to inhibit the shift discharge of the sheet of the current job by said shift sheet discharging means.

38. An apparatus according to claim 36, wherein the immediately preceding job is the job already processed, and the current job is the job to which processing has not ended, and said control means includes discrimination means for discriminating whether the size of the sheet of the current job is different from the size of a sheet of the immediately preceding job.

39. An apparatus according to claim 36, wherein said shift sheet discharging means includes tray shift means for shifting the tray in a horizontal direction to perform the shift discharge.

40. An apparatus according to claim 39, wherein said tray shift means shifts the tray in a direction perpendicular to a sheet discharge direction.

41. An apparatus according to claim 36, wherein said shift sheet discharging means includes shift means for shifting the sheet in a horizontal direction to perform the shift discharge before storing the sheet on the tray.

42. An apparatus according to claim 41, wherein said shift means shifts the sheet in a direction perpendicular to a sheet discharge direction.

43. An apparatus according to claim 36, wherein said shift sheet discharging means discharges the sheet to any one of a plurality of trays.

44. An apparatus according to claim 36, further comprising image forming means for forming an image on the sheet.

45. An apparatus according to claim 36, wherein said shift sheet discharging means performs the shift discharge of the sheets of one of the immediately preceding or current job, which is composed of a plurality of sheets.

46. An apparatus including shift sheet discharging means for performing a shift discharge of a sheet such that the sheet to be discharged on a tray is stored in a shifted position with respect to a sheet of an immediately preceding job already stored on the tray, said apparatus comprising:

control means for controlling execution/nonexecution of the shift discharge of a sheet of a current job by said shift sheet discharging means, on the basis of a direction of a sheet of the an immediately preceding job and a direction of the sheet of the current job processed after the an immediately preceding job.

47. An apparatus according to claim 46, wherein when a direction of the sheet of the current job is coincident with a direction of the sheet of the immediately preceding job, the control means performs a control to permit the shift discharge of the sheet of the current job by said shift sheet discharging means, and when the direction of the sheet of the current job is different from the direction of the sheet of the immediately preceding job, said control means performs a control to inhibit the shift discharge of the sheet of the current job by said shift sheet discharging means.

48. An apparatus according to claim 46, wherein the immediately preceding job is a job already processed, and the current job is a job in which processing has not ended, and said control means includes discrimination means for discriminating whether the direction of the sheet of the current job is different from the direction of the sheet of the immediately preceding job.

49. An apparatus according to claim 46, wherein said shift sheet discharging means includes tray shift means for shifting the tray in a horizontal direction to perform the shift discharge.

50. An apparatus according to claim 49, wherein said tray shift means shifts the tray in a direction perpendicular to a sheet discharge direction.

51. An apparatus according to claim 46, wherein said shift sheet discharging means includes shift means for shifting the sheet in a horizontal direction to perform shift sheet discharging before storing the sheet on the tray.

52. An apparatus according to claim 51, wherein said shift means shifts the sheet in a direction perpendicular to a sheet discharge direction.

53. An apparatus according to claim 46, wherein said shift sheet discharging means discharges the sheet to any one of a plurality of trays.

54. An apparatus according to claim 46, further comprising image forming means for forming an image on the sheet.

55. An apparatus according to claim 46, wherein said shift sheet discharging means performs the shift discharge of the sheets of one of the immediately preceding or current job, which is composed of a plurality of sheets.

56. An apparatus including shift sheet discharging means for performing a shift discharge a sheet such that the sheet to be discharged on a tray is stored in a shifted position with respect to a sheet of an immediately preceding job already stored on the tray, said apparatus comprising:

control means for controlling execution/nonexecution of said shift sheet discharging means, on the basis of a type of a sheet of an immediately preceding job and a type of the sheet of a current job processed after the immediately preceding job.

57. An apparatus according to claim 56, wherein when a type of the sheet of the current job is similar to a type of the sheet of the immediately preceding job, said control means performs the control to permit the shift discharge of the sheet of the current job by said shift sheet discharging means, and when a type of the sheet of the current job is different from the type of the sheet of the immediately preceding job, said control means performs a control to inhibit the shift discharge of the sheet of the current job by said shift sheet discharging means.

58. An apparatus according to claim 56, wherein the immediately preceding job is a job already processed, and the current job is the job in which processing has not ended, and said control means includes discrimination means for discriminating whether a type of the sheet of the current job is different from a type of the sheet of the immediately preceding job.

59. An apparatus according to claim 56, wherein said shift sheet discharging means includes tray shift means for shifting the tray in a horizontal direction to perform the shift discharge.

60. An apparatus according to claim 59, wherein said tray shift means shifts the tray in a direction perpendicular to a sheet discharge direction.

61. An apparatus according to claim 56, wherein said shift sheet discharging means includes shift means for shifting the sheet in a horizontal direction to perform the shift sheet discharge before storing the sheet on the tray.

62. An apparatus according to claim 61, wherein said shift means shifts the sheet in a direction perpendicular to a sheet discharge direction.

63. An apparatus according to claim 56, wherein said shift sheet discharging means discharges the sheet to any one of a plurality of trays.

64. An apparatus according to claim 56, further comprising image forming means for forming an image on the sheet.

65. An apparatus according to claim 56, wherein said shift sheet discharging means performs the shift discharge of the sheets of one of the immediately preceding or current job, which is composed of a plurality of sheets.

66. A control method for an apparatus including shift sheet discharging means for performing a shift discharge of a sheet such that the sheet to be discharged on a tray is stored in a shifted position with respect to a sheet of an immediately preceding job already stored on the tray, the method comprising the step of:

controlling execution/nonexecution of the shift discharge of a sheet of a current job by the shift sheet discharging means, on the basis of a size of a sheet of the immediately preceding job and a size of the sheet of the current job processed after the immediately preceding job.

67. A control method according to claim 66, wherein when the size of the sheet of the current job is similar to a size of the sheet of the immediately preceding job, the controlling step performs a control to permit a shift discharge of the sheet of the current job by the shift sheet discharging means, and when the size of the sheet of the current job is different from the size of the sheet of the immediately preceding job, the controlling step performs a control to inhibit a shift discharge of the sheet of the current job by the shift sheet discharging means.

68. A control method according to claim 66, wherein the immediately preceding job is a job already processed, and the current job is a job in which processing has not ended, and said controlling step includes a step of discriminating whether a size of the sheet of the current job is different from a size of the sheet of the immediately preceding job.

69. A control method according to claim 66, wherein the shift sheet discharging means includes a tray shift means for shifting the tray in a horizontal direction to perform the shift discharge.

70. A method according to claim 69, wherein the tray shift means shifts the tray in a direction perpendicular to a sheet discharge direction.

71. A method according to claim 66, wherein the shift sheet discharging means includes a shift means for shifting the sheet in a horizontal direction to perform the shift sheet discharging before storing the sheet on the tray.

72. A method according to claim 71, wherein the shift means shifts the sheet in a direction perpendicular to a sheet discharge direction.

73. A method according to claim 66, wherein the shift sheet discharging means discharges the sheet to any one of a plurality of trays.

74. A method according to claim 66, further comprising a step of forming an image on the sheet.

75. A method according to claim 66, wherein the shift sheet discharging means performs the shift discharge to the sheets of one of the immediately preceding or current job, which is composed of a plurality of sheets.

76. A control method for an apparatus including shift sheet discharging means for performing a shift discharge of a sheet such that the sheet to be discharged on a tray is stored in a shifted position with respect to a sheet of an immediately preceding job already stored on the tray, the method comprising the step of:

controlling execution/nonexecution of the shift discharge to a sheet of a current job by the shift sheet discharging means, on the basis of a direction of a sheet of the immediately preceding job and a direction of the sheet of the current job processed near in time to the immediately preceding job.

77. A method according to claim 76, wherein when the direction of the sheet of the current job is coincident with the direction of the sheet of the immediately preceding job, the control step performs a control to permit the shift discharge of the sheet of the current job by the shift sheet discharging means, and when the direction of the sheet of the current job is different from the direction of the sheet of the immediately preceding job, the control step performs a control to inhibit the shift discharge of the sheet of the current job by the shift sheet discharging means.

78. A method according to claim 76, wherein the immediately preceding job is the job already processed, and the current job is the job in which the process has not ended, and the control step includes a step of discriminating whether the direction of the sheet of the current job is different from the direction of the sheet of the immediately preceding job.

79. A method according to claim 76, wherein the shift sheet discharging means includes a tray shift means for shifting the tray in a horizontal direction to perform the shift discharge.

80. A method according to claim 79, wherein the shift sheet discharging means includes a tray shift means for shifting the tray in a horizontal direction to perform the shift discharge.

81. A method according to claim 76, wherein the shift sheet discharging means includes a shift means for shifting the sheet in a horizontal direction to perform shift sheet discharging before storing the sheet on the tray.

82. A method according to claim 81, wherein the shift means shifts the sheet in a direction perpendicular to a sheet discharge direction.

83. A method according to claim 76, wherein the shift sheet discharging means discharges the sheet to any one of a plurality of trays.

84. A method according to claim 76, further comprising a step of forming an image on the sheet.

85. A method according to claim 76, wherein the shift sheet discharging means performs the shift discharge to the sheets of one of the immediately preceding or current job, which is composed of a plurality of sheets.

86. A control method for an apparatus including shift sheet discharging means for performing shift discharging of a sheet such that a sheet to be discharged on a tray is stored in a shifted position with respect to a sheet of an immediately preceding job already stored on the tray, the method comprising the step of:

controlling execution/nonexecution of a shift discharge of a sheet of a current job by the shift sheet discharging means, on the basis of a type of a sheet of the immediately preceding job and a type of the sheet of the current job processed near in time to the immediately preceding job.

87. A method according to claim 86, wherein when a type of the sheet of the current job is coincident with a type of the sheet of the immediately preceding job, the control step performs a control to permit the shift discharge of the sheet of the current job by the shift sheet discharging means, and when the type of the sheet of the current job is different from the type of the sheet of the immediately preceding job, the control step performs a control to inhibit the shift discharge of the sheet of the current job by the shift sheet discharging means.

88. A method according to claim 86, wherein the immediately preceding job is a job already processed, and the current job is a job in which processing has not ended, and the control step includes a step of discriminating whether a type of the sheet of the current job is different from a type of the sheet of the Immediately preceding job.

89. A method according to claim 86, wherein the shift sheet discharging means includes a tray shift means for shifting the tray in a horizontal direction to perform the shift discharge.

90. A method according to claim 89, wherein the tray shift means shifts the tray in a direction perpendicular to a sheet discharge direction.

91. A method according to claim 86, wherein the shift sheet discharging means includes a shift means for shifting the sheet in a horizontal direction to perform shift sheet discharging before storing the sheet on the tray.

92. A method according to claim 91, wherein the shift means shifts the sheet in a direction perpendicular to a sheet discharge direction.

93. A method according to claim 86, wherein the shift sheet discharging means discharges the sheet to any one of a plurality of trays.

94. A method according to claim 86, further comprising a step of forming an image on the sheet.

95. A method according to claim 86, wherein the shift sheet discharging means performs the shift discharge of the sheet of one of the immediately preceding or current job, which is composed of a plurality of sheets.

96. A computer-readable storage medium which stores a program to cause an apparatus including a binding process means for performing a binding process to sheets in a binding job; and a shift sheet discharging means for performing a shift discharge of a sheet such that the sheet to be discharged on a tray is stored in a shifted position with respect to a sheet of an immediately preceding job already stored on the tray, the medium including code to execute the step of:

controlling, in a case where a current job processed near in time to the immediately preceding job is a nonbinding job, the shift sheet discharging means to permit the shift discharge to a sheet of the current job by the shift sheet discharging means when the immediately preceding job is a nonbinding job, and to inhibit the shift discharge of a sheet of the current job when the immediately preceding job is a binding job.

97. A computer-readable storage medium, which stores a program to cause an apparatus including shift sheet discharging means for performing a shift discharge of a sheet such that the sheet to be discharged is shifted with respect to a sheet of an immediately preceding job already stored on the tray, the medium including code to execute the step of:

controlling execution/nonexecution of the shift discharge of a sheet of a current job by the shift sheet discharging means, on the basis of the size of a sheet of the immediately preceding job and the size of a sheet of the current job processed near in time to the immediately preceding job.

98. A computer-readable storage medium, which stores a program to cause an apparatus including shift sheet discharging means for performing a shift discharge of a sheet such that the sheet to be discharged on a tray is stored in a shifted position with respect to a sheet of an immediately preceding job already stored on the tray, the medium including code to execute the step of:

controlling execution/nonexecution of the shift discharge of a sheet of a current job by the shift sheet discharging means, on the basis of the direction of a sheet of the immediately preceding job and the direction of the sheet of the current job processed near in time to the immediately preceding job.

99. A computer-readable storage medium which stores a program to cause an apparatus including shift sheet discharging means for performing a shift discharge of a sheet such that the sheet to be discharged on a tray is stored in a shifted position with respect to a sheet of an immediately preceding job already stored on the tray, the medium including code to execute the step of:

controlling execution/nonexecution of the shift discharge of a sheet of a current job by the shift sheet discharging means, on the basis of a type of a sheet of the immediately preceding job and a type of the sheet of the current job processed near in time to the immediately preceding job.

* * * * *

UNITED STATES PATENT AND TRADEMARK OFFICE

CERTIFICATE OF CORRECTION

PATENT NO. : 6,390,465 B1
APPLICATION NO. : 09/160383
DATED : May 21, 2002
INVENTOR(S) : Kakigi It is certified that error appears in the above-identified patent and that said Letters Patent is hereby corrected as shown below:

ON TITLE PAGE, AT ITEM (57):

Line 2, “any” should read --and--; and
Line 4, “charging” should read --charging unit--.

COLUMN 1:

Line 15, “In” should read --In the--;
Line 16, “a” should read --an--;
Line 17, “sheet” should read --sheet discharge--;
Line 37, “An another” should read --Another--; and
Line 42, “A still” should read --Still--.

COLUMN 2:

Line 46, “devices” should read --devices and--.

COLUMN 4:

Line 28, “Such” should be deleted;
Line 29, “the” should read --The--; and
Line 40, “a” (second occurrence) should read --an--.

COLUMN 5:

Line 42, “setting” should read --settings--.

COLUMN 6:

Line 18, “added with” should read --denoted by--; and “materials.” should read --numerals.--.

COLUMN 8:

Line 17, “an” should be deleted;
Line 20, “once” should read --first--;
Line 26, “once” should read --first--; and
Line 32, “once” should read --first--.

UNITED STATES PATENT AND TRADEMARK OFFICE

CERTIFICATE OF CORRECTION

PATENT NO. : 6,390,465 B1
APPLICATION NO. : 09/160383
DATED : May 21, 2002
INVENTOR(S) : Kakigi It is certified that error appears in the above-identified patent and that said Letters Patent is hereby corrected as shown below:

COLUMN 9:

Line 5, “maximumly” should read --a maximum of--;
Line 59, “105” should read --106--; and
Line 66, “tune” should read --timer--.

COLUMN 10:

Line 4, “elapsing” should read --the lapse of--;
Line 13, “to such the” (second occurrence) should read --of such--;
Line 25, “data,” should read --data to be used to form page information and print information (S701). If the sent data includes the print data,--;
Line 40, “an” should be deleted; and
Line 54, “In” should read --In the--.

COLUMN 11:

Line 2, “of the” should read --of--;
Line 12, “any message is not” should read --no message is--;
Line 22, “If” should read --If it--;
Line 25, “in such” should read --it is in--;
Line 35, “After then, the” should read --Then the--;
Line 46, “what” should read --that--; and
Line 47, “such a case as” should read --a case in which--.

COLUMN 12:

Line 11, “job” should read --job is different from that in the present-time job--.

COLUMN 14:

Line 40, “shift a” should read --a shift--.

COLUMN 15:

Line 18, “shifted position” should read --shifted to a position--.

UNITED STATES PATENT AND TRADEMARK OFFICE

CERTIFICATE OF CORRECTION

PATENT NO. : 6,390,465 B1
APPLICATION NO. : 09/160383
DATED : May 21, 2002
INVENTOR(S) : Kakigi It is certified that error appears in the above-identified patent and that said Letters Patent is hereby corrected as shown below:

COLUMN 17:

Line 24, “the” should be deleted; and
Line 26, “the” should be deleted.

COLUMN 18:

Line 2, “a” (second occurrence) should read --of a--.

COLUMN 20:

Line 44, “Immediately” should read --immediately--.

Signed and Sealed this

Fourteenth Day of November, 2006

JON W. DUDAS
*Director of the United States Patent and Trademark Office*